US011220793B2

(12) United States Patent
Kelly

(10) Patent No.: US 11,220,793 B2
(45) Date of Patent: Jan. 11, 2022

(54) COMPACTION COMPENSATION SYSTEM

(71) Applicant: Anthony Kelly, Thurles (IE)

(72) Inventor: Anthony Kelly, Thurles (IE)

( * ) Notice: Subject to any disclaimer, the term of this patent is extended or adjusted under 35 U.S.C. 154(b) by 0 days.

(21) Appl. No.: 16/339,924

(22) PCT Filed: Oct. 5, 2017

(86) PCT No.: PCT/EP2017/075423
§ 371 (c)(1),
(2) Date: Apr. 5, 2019

(87) PCT Pub. No.: WO2018/065551
PCT Pub. Date: Apr. 12, 2018

(65) Prior Publication Data

US 2020/0048843 A1 Feb. 13, 2020

(30) Foreign Application Priority Data

Oct. 7, 2016 (GB) ..... 1617088

(51) Int. Cl.

| | |
|---|---|
| ***E01C 23/01*** | (2006.01) |
| ***E01C 19/00*** | (2006.01) |
| ***E01C 19/48*** | (2006.01) |
| *E01C 23/088* | (2006.01) |
| *E02F 3/84* | (2006.01) |

(52) U.S. Cl.
CPC ..... *E01C 19/008* (2013.01); *E01C 19/48* (2013.01); *E01C 23/01* (2013.01); *E01C 23/088* (2013.01); *E01C 2301/10* (2013.01); *E02F 3/84* (2013.01)

(58) Field of Classification Search
CPC ..... E01C 23/01; E01C 19/008; E01C 19/006; E01C 19/48
USPC ..... 404/84.1, 118
See application file for complete search history.

(56) References Cited

U.S. PATENT DOCUMENTS

| | | | | |
|---|---|---|---|---|
| 3,236,163 A * | 2/1966 | Ackerman | E01C 19/008 | 404/84.1 |
| 3,264,958 A * | 8/1966 | Babb | E01C 19/486 | 404/84.1 |
| 3,264,959 A * | 8/1966 | Shea | E01C 19/486 | 404/84.1 |

(Continued)

OTHER PUBLICATIONS

International Search Report; priority document PCT/EP2017/075423 , dated Jan. 2018.

*Primary Examiner* — Gary S Hartmann
(74) *Attorney, Agent, or Firm* — Greer, Burns & Crain, Ltd.

(57) ABSTRACT

A compaction compensation system comprising a mechanism for automatically height adjusting the height adjustable mounting (30) so as to height adjust the sensor relative to the screed by a compaction compensating factor. It is used in a paving machine (1) for laying compactable paving material, the paving machine comprising: (a) a height adjustable screed (5) for laying a layer of compactable paving material onto a surface; (b) a sensor (15,17) for sensing the height of the screed relative to a reference level, the sensor being attached to the screed by a height adjustable mounting; (c) a screed height control system for automatically adjusting the height of the screed in response to different heights sensed by the sensor due to contours of the surface, so as to adjust the screed to lay a layer of varying thickness.

24 Claims, 10 Drawing Sheets

(56) References Cited

U.S. PATENT DOCUMENTS 3,323,427 A * 6/1967 Schrimper ..... E01C 19/008 404/84.1
3,519,770 A * 7/1970 Long ..... H01H 13/18 200/61.42
3,602,113 A 8/1971 Davin et al.
3,810,676 A * 5/1974 Clarke ..... B25D 9/08 299/1.5
3,811,787 A * 5/1974 Beaty ..... E01C 19/008 404/84.1
3,846,035 A * 11/1974 Davin ..... E01C 19/4873 404/84.1
3,877,830 A * 4/1975 James, III ..... E01C 19/4873 404/84.1
3,989,402 A * 11/1976 James, III ..... E01C 19/4873 404/110
4,823,366 A * 4/1989 Williams ..... E01C 19/006 198/502.2
5,393,167 A * 2/1995 Fujita ..... E01C 19/006 404/118
5,599,134 A 2/1997 Macku et al.
5,702,201 A * 12/1997 Macku ..... E01C 19/008 404/75
5,984,420 A 11/1999 Murray et al.
6,452,684 B1 * 9/2002 Mennink ..... E01C 19/006 356/601
7,530,641 B2 * 5/2009 Berning ..... B28D 1/18 299/1.5
7,559,718 B2 * 7/2009 Zachman ..... E01C 19/004 404/83
8,070,385 B2 * 12/2011 Green ..... E01C 19/006 404/118
8,696,237 B2 * 4/2014 Hanfland ..... G01B 21/08 404/118
8,944,719 B2 * 2/2015 Frelich ..... E01C 19/00 404/108
9,033,611 B2 * 5/2015 Hanfland ..... E01C 19/48 404/84.1
9,290,894 B2 * 3/2016 Eul ..... E01C 23/07
9,534,349 B2 * 1/2017 Horn ..... G01B 5/06
9,938,673 B2 * 4/2018 Ellwein ..... B60R 21/013
9,988,773 B2 * 6/2018 Horn ..... E01C 19/42
10,227,738 B2 * 3/2019 Horn ..... E01C 19/48
10,287,733 B2 * 5/2019 Herzberg ..... G01B 5/0002
10,287,734 B2 * 5/2019 Herzberg ..... E01C 19/48

* cited by examiner

COMPACTION COMPENSATION SYSTEM

FIELD OF THE INVENTION

The present invention relates to a compaction compensation system. In particular, the invention relates to a compaction compensation system for compactible materials that can be laid, for example as paving. Such materials are well known in the art and include typically aggregate and a binder. Asphalt is one common material which is used in this respect. Of interest are paving machines for laying down layers of compactible materials.

BACKGROUND TO THE INVENTION

It is well-known to use paving machines, to lay compactible materials down on a level surface. For example, a wide range of machines are available for paving roads. Such machines typically have a hopper (at the front) for receiving the compactible material to be laid, a mechanism for creating a layer or mat of the compactible material, and an adjustable screed which is adjusted to lay a desired height (thickness) of the compactible material onto a surface. The surface onto which the material is placed is may be referred to as a subgrade.

Often, a reference level is utilised to which a screed level is referenced. The reference level could be a line such as a wire that has been set up to establish a reference level or a level may be taken from another layer of material that has already been set down (e.g. subgrade), or for example a kerb line.

Often paving machines include a sensing system which can be pre-set to maintain the desired level of an adjustable screed relative to the reference level. As the machine drives along its wheels (or tracks) encounter contours in the surface over which it travels. This in turn causes movement of the machine and the position of the screed is affected. As the wheels of the machine pass over such contours, the sensing system detects changes relative to the reference level. The system is automated to adjust the level of the screed in response to the detected change relative to the reference level.

This means that any changes in the height of the screed in response to the movement of the machine over contours are compensated for and an adjustment is made to try and lay the material in a substantially level layer or mat. The layer is level in a direction of travel.

It is to be noted that a level layer is achieved by setting down different thicknesses of compactible material.

After the layer of material is laid down it is often compacted further for example by rollers. (Indeed, many paving machines include tampers, for example double tampers or vibrators, which will at least partially tamp down or pre-compact the material as it is laid. Further compaction is then carried out by rollers.)

However, there is a further complication. Just because a layer is level as laid down, does not mean it will be level after compaction.

With the movement of the screed to achieve a level layer finish, thicker and thinner layers are laid down in order to compensate for the contours in the surface. This is a level layer but of varying thickness. If one assumes for example a nominal compaction percentage or factor, say 10%, compaction of the layers, it will be quickly appreciated that if one part of the layer is thicker than another, then, after (say 10%) compaction, the thicker part will compact by a greater amount and thus what had been laid down by the paving machine as a level surface, becomes undulating. So, due to differential compaction, the level surface as laid then changes to become undulating reflecting the contours of the underlying surface once compaction has taken place. Though of course as the contours of the underlying surface are imparted after compaction, the contours of the underlying surface that are present in the material after compaction are substantially less than that of the underlying surface.

Of course it is the final compacted material that defines the end-use surface so it is desirable that the surface is as level as possible after compaction. This means as smooth as possible a ride for vehicles passing over the surface.

U.S. Pat. No. 3,602,113 (GB 1,310,746) describes a paving apparatus for automatically control the "crown" when making a crown transition. The crown is the convex profile of the mat of material being laid.

U.S. Pat. No. 5,984,420 describes a grade averaging system with a floating boom. The floating boom is maintained at a constant angular orientation of the boom relative to a reference line. The system is utilised with respect to a pavement milling machine. The grade averaging system height adjusts the machine relative to its wheels. The system does not address the problem of differential compaction described above.

U.S. Pat. No. 5,599,134 describes a compaction compensating system based on the use of a longer averaging ski and a shorter compensating ski, or using a compensating ski and a reference line, or using two sensors. The aim is to address differential compaction and compensate for that using a constant compaction factor or ratio. However the set-up in U.S. Pat. No. 5,599,134 is complex and it is not easy for an operator of such a paving machine to set it up for initial use or to adjust it as necessary.

SUMMARY OF THE INVENTION

In the present invention the expression compaction factor or ratio is the factor/ratio by which a material is expected to compact. For example a material laid at 50 mm in depth may be expected to compact to 40 mm. This represents a compaction factor or ratio of 20%—the material compacts by 20% of its original value 20% of 50 mm. The amount of the compaction is 10 mm.

It will be appreciated that the compaction factor or ratio differs from the amount of compaction. Even with a constant compaction factor or ratio the amount of compaction will vary. So if a material is assumed to compact by 20% of its original value a 50 mm layer will compact by 10 mm to 40 mm; a layer with an original value of 40 mm will compact by 8 mm to 32 mm etc. So the amount of compaction varies even though a constant compaction factor or ratio applies.

The present invention provides a system that dynamically changes the compaction factor applied while a paving machine is in use. That dynamic change is based on changes in the surface on which the material is being laid. So a compaction compensation system of the present invention not only takes into account a change in thickness of material to be laid due to changes in the height of the surface on which the material is to be laid, but it also applies a compaction compensation factor to the thickness of material to be laid so that the thickness of material actually laid is adjusted not only for the changes in height of the surface on which it is laid, but to take account of the fact that different thicknesses compact by different amounts so that upon compaction the material compacts to form a level compacted surface. Effects related to differential compaction due to different thicknesses compacting by different amounts are thus minimised.

The present invention provides a compaction compensation system for a paving machine for laying compactable paving material, the paving machine comprising:

(i) a height adjustable screed for laying a layer of compactable paving material onto a surface;

(ii) a sensor for sensing the height of the screed relative to a reference level, the sensor being attached to the screed by a height adjustable mounting;

(iii) a screed height control system for automatically adjusting the height of the screed in response to different heights sensed by the sensor due to contours of the surface, so as to adjust the screed to lay a layer of varying thickness;

the compaction compensation system comprising:

a mechanism for automatically height adjusting the height adjustable mounting so as to height adjust the sensor relative to the screed by applying to the height adjustment a compaction compensating factor.

Height adjusting the sensor relative to where it is mounted to the screed, is a clever simple way of factoring in a compaction compensation factor to the screed height. This is because the screed control system will automatically include such movement. In such a way, the screed control system is presented with conditions where it thinks that the level of the ground has moved whereas in fact it is the distance from the sensor to the reference level that is changed. The system of the invention can be provided in a simple mechanical form. It can be easily retrofitted to existing paving machines. It can be fitted at a position where it is between a screed and the sensor. It will then height adjust the sensor so that the screed control system automatically takes into account the perceived changes between the centre and the reference level due to this height change of the sensor itself relative to the screed.

It will be appreciated that in a paving machine for use with a system of the present invention the screed is height adjustable relative to the (chassis of the) paving machine.

The mechanism is typically located between the sensor and the screed.

The mechanism moves the point at which the sensor is attached to the screed (thus adjusting the relative height of the sensor to the screed).

The present invention also provides a compaction compensation system for a paving machine for laying compactable paving material, the paving machine comprising:

(i) a height adjustable screed for laying a layer of compactable paving material onto a surface;

(ii) a sensor for sensing the height of the screed relative to a reference level, the sensor being attached to the screed;

(iii) a screed height control system for automatically adjusting the height of the screed in response to different heights sensed by the sensor due to contours of the surface, so as to adjust the screed to lay a layer of varying thickness;

the compaction compensation system for applying a compaction compensation to the screed height control system based on the thickness of the layer being laid down at a given point in time and comprising:

(iv) a mechanism for automatically adjusting the compaction compensation factor based on the thickness (depth) of the layer being laid down at a given point in time.

The present invention thus provides a system that dynamically changes the compaction factor applied while a paving machine is in use. That dynamic change is based on changes in the surface on which the material is being laid.

Ideally, the concept of height changing the sensor relative to the screed, and the concept of automatically adjusting the compaction compensation factor are used together, but they are independent concepts and can each be used independently of each other and/or with other features described herein.

The sensor may be attached to the screed by a height adjustable mounting and the compaction compensation system comprises a mechanism for automatically height adjusting the height adjustable mounting so as to height adjust the sensor relative to the screed by applying to the height adjustment a compaction compensating factor.

Desirably a compaction compensation system according to the invention comprises a mechanism for automatically adjusting the compaction compensation factor based on the thickness of the layer being laid down at a given point in time.

It is desirable that the screed height control system operates on the principle of maintaining the sensor at a fixed height from the reference level. This is a simple system which allows the adjustment to be factored into the screed control system easily.

Desirably the sensor is a contactless sensor. For example it may be an ultrasonic sensor etc.

A compaction compensation system of the invention may further comprise a surface level detector for running along and following the contours of the surface onto which the paving material is to be laid. It is desirable to be in a position to compare the surface level to the reference level as this comparison can be done within the screed control system.

The surface level detector may be a surface runner for running along and moving up and down relative to the paving machine so as to follow the contours of the surface onto which the compactable paving material is to be laid, and which is connected to the height adjuster and moves the height adjuster by an amount that is proportionate to its own movement. The surface runner could be one or more skids, including a ski, or one or more wheel or rollers or any combination thereof. The surface runner may include the wheels of the paving machine itself as exemplified below. Desirably however the surface runner is separate from (independent of) the wheels of the paving machine and it itself runs along the surface (independently of the wheels of the paving machine).

It is desirable that the compaction compensation system is adjustable to be pre-set for different compensating factors based on different expected compaction of different compactable paving material. This means that simple pre-set values, for example a scale with pre-set values can be presented to a user. In this way the user can simply select the desired pre-set value instead of trying to make an adjustment themselves.

Suitably the compensating factor is adjustable by varying the distance between the surface level detector and the height adjuster in the direction of travel. This is a very simple adjustment which can be made by a user. Furthermore where pre-set values are marked for the user, the user can very simply select the value that is desired for the given use (material and depth being laid).

In one very simple, but highly effective system that is easily retrofitted to existing machines, the sensor and the surface level detector are connected via a lever and their respective connection positions relative to the lever determines the compensating factor. Simply put, the movement experienced at any point on a lever depends on its distance from the fulcrum about which the lever moves. Accordingly, choosing different connection points on the lever can be used to vary the relative movement of two parts such as the sensor and the surface level detector. This in turn allows for (continuously variable) adjustment of the compaction compensation factor in a system of the invention.

Desirably the sensor is mounted to the lever at a position between a fulcrum of the lever and the surface level detector. Again a simple arrangement which allows for effective transmission of a compaction compensation factor from the surface level detector to the sensor.

The height adjustable mounting may itself be length adjustable so as to allow variation of the compaction compensating factor. This provides a simple additional or alternative mechanism for adjustment of the compaction compensating factor.

In many paving machines the screed is moved by a screed arm. It is desirable that the sensor is mounted to the machine by such an arm that is fixed to the screed.

The height adjuster may adjust the height of the sensor relative to the arm.

In essence then the (direct or indirect) connection of the sensor to the screed or screed arm is shortened or lengthened based on a compaction compensation factor. This height adjusts the sensor relative to the screed or screed arm.

It is desirable that the screed height control system operates to maintain the sensor at a pre-set height relative to the reference level. This is a simple system, and fits well with the compaction compensation system of the invention. It allows for easy calculation of the effect of a system of the invention in relation to imparting a compaction compensation factor to height adjust the sensor relative to the screed (or screed arm).

A compaction compensation system according to the invention may comprise: a compaction adjustment mechanism for automatically adjusting the compaction compensation factor based on the thickness of the layer being laid down at a given point in time, and wherein the mechanism includes:

(i) a surface level detector for running along and following the contours of the surface onto which the paving material is to be laid, (ii) an inclined surface, and (iii) an inclined surface runner that runs up and down the inclined surface in response to movement of the surface level detector due to contours of the surface onto which the paving material is to be laid.

This allows for two different factors to be applied to the screed, optionally by adjustment of the sensor height relative to the screed (or screed arm). The first factor is the pre-set compaction compensation factor which is based on an experienced deviation on the surface on which the material is being laid. The second factor is a factor that takes into account the fact that there may be a non-linear relationship between the depth of material being laid and the amount that it compacts (at an assumed constant compaction pressure). Accordingly the system of the invention allows for (dynamic and automatic) adjustment of the compaction compensation factor.

The inclined surface may be a curvilinear surface. A curvilinear surface may represent a curvilinear deviation of the compaction compensation factor of a material based on its thickness/depth.

The surface level detector may comprise the inclined surface. This is a simple way of combining the two factors into an overall or cumulative compensation factor.

The surface level detector may include a dolly with an inclined surface.

Desirably the inclined surface is adjustable to provide different inclinations.

For example the inclined surface may be curved optionally taking the form of a continuous arc.

Desirably the sensor is attached to the screed by a height adjustable mounting and the compaction compensation system comprises a mechanism for automatically height adjusting the height adjustable mounting so as to height adjust the sensor relative to the screed by a compaction compensating factor and the compaction compensation system further comprises a mechanism for automatically adjusting the compaction compensation factor.

The automatic adjustment of the compaction compensation factor may be based on the movement of the inclined surface runner on the inclined surface in response to movement of the surface level detector due to contours of the surface onto which the paving material is to be laid.

The automatic adjustment of the compaction compensation factor may be done by a compaction adjustment mechanism for automatically adjusting the compaction compensation factor. Optionally the compaction adjustment mechanism applies a non-linear correction/adjustment to the compaction compensation factor.

A compaction compensation system of the invention may comprise:

(i) a surface level detector for running along and following the contours of the surface onto which the paving material is to be laid, (ii) an inclined surface (iii) an inclined surface runner that runs up and down the inclined surface (iv) wherein the compaction compensation factor being applied is adjustable by:

(v) changing the inclination optionally the rate of inclination and/or the angle of inclination; and/or (vi) changing the relative position of the inclined surface to the surface runner that runs on the inclined surface runner (this represents a dynamically adjusted compaction compensation factor).

One way of achieving this is by changing the tow-point of the surface runner, for example the height at which the surface runner is towed relative to the paving machine. For example the surface level detector may be towed by the paving machine and the compaction compensation factor is adjustable (either by pre-setting the position, or dynamically) by changing the tow position relative to the paving machine for example the position relative to the direction of travel relative to the paving machine and/or the height of the tow position relative to the paving machine.

The present invention also relates to a paving machine comprising:

(i) a height adjustable screed for laying a layer of compactable paving material onto a surface;

(ii) a sensor for sensing the height of the screed relative to a reference level, the sensor being attached to the screed;

(iii) a screed height control system for automatically adjusting the height of the screed in response to different heights sensed by the sensor due to contours of the surface, so as to adjust the screed to lay a layer of varying thickness; and (iv) a compaction compensation system according to the invention.

With the invention and based on the varying thickness of a layer the height of the screed relative to the reference level detected by the sensor will be adjusted by an factor compensating for differential compaction of the varying thickness of the layer.

Thus, with a system of the invention, the layer of compactable paving material before compaction will vary in thickness. Also, before compaction that layer will not be entirely level. Instead, the layer will have imparted to it different levels each different level including a compensating factor for the differential compaction of the different thicknesses of the material being laid down. Overall therefore, after compaction, the layer will be substantially level.

Such a compaction compensating mechanism compensates for compaction of material which does not have a constant compaction factor when the depth of the laid material varies. It changes the compaction factor applied. In this way the compaction compensating mechanism of the invention compensates for compaction of materials which has an inconstant compaction factor when the depth of the laid material varies.

Of course a compaction compensation system of the invention allows the compaction factor to be automatically applied while the paving machine is moving, and also, it allows the compaction factor to be automatically varied while the paving machine is moving along.

In relation to the use of a system of the invention, or a paving machine of the invention, use is intended to be in use laying a paving material such as asphalt or roller compacted concrete (RCC). Typically then references to motion across a (ground) surface when the machine means motion in the direction of travel.

In any embodiment of the invention the screed control system may include a control that adjusts the "angle of attack" of the screed relative to the underlying surface/the material to be laid.

BRIEF DESCRIPTION OF THE DRAWINGS

Embodiments of the invention will be described, by way of example only, with reference to the accompanying drawings in which.

DETAILED DESCRIPTION OF THE DRAWINGS

The present invention will now be described with reference to the Figures.

Figure 1:
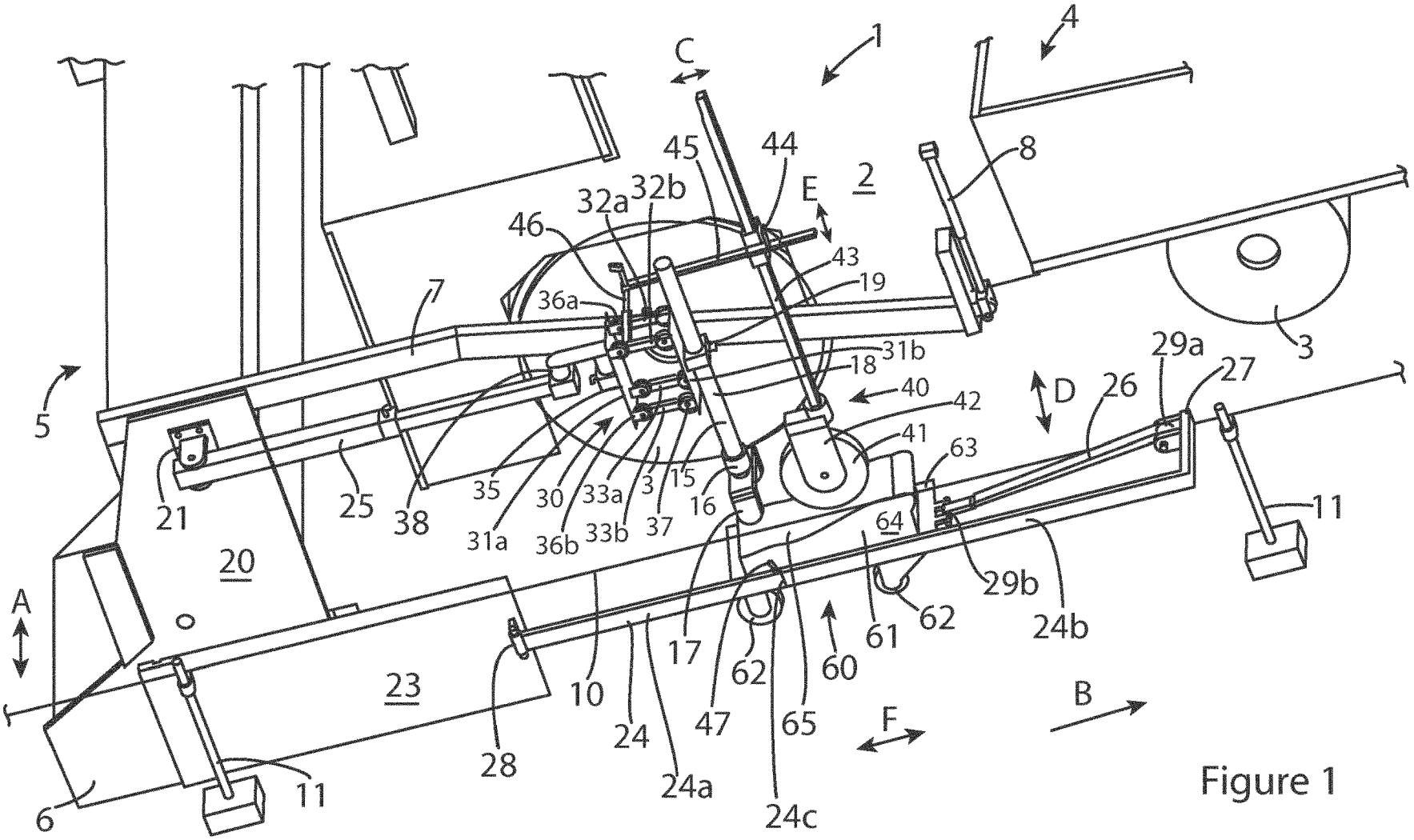
FIG. 1 is a schematic representation of a paving machine such as an asphalt machine incorporating a compaction compensation system of the invention.

FIG. 1 shows a simplified schematic representation of a paving machine 1 for laying compactable paving material. It has a machine body 2 which travels on wheels 3. A hopper 4 is provided (at the front of the machine 1) into which the compactible paving material is received. The machine has a mechanism (typically conveyor and/or screw mechanisms) for creating a layer or mat of the compactible paving material, and an adjustable screed 5 (at the rear of the machine) which is adjustable to lay a desired height (thickness) of the compactible material onto a surface. The screed optionally has an adjustable section 6 which may be extended or retracted as indicated by arrow A, for laying down varying widths of the compactible paving material.

The machine 1 includes a screed height control system for automatically adjusting the height of the screed 5. The screed 5 is mounted to the paving machine 1 by a screed arm 7. The screed arm 7 extends forward from the screed 5 and is attached to the machine body using a height adjustment mechanism. The height adjustment mechanism includes a two-way ram 8. The ram 8 can move the arm 7 up or down relative to the machine 1, and in turn moves the screed 5 up or down. This means that as the machine moves in the direction of travel (indicated by arrow B) the height of screed 5 (relative to the surface over which it travels) can be adjusted.

A reference level is provided by a line 10, often called a piano wire. The line 10 is set out to provide a reference level for the paving machine 1. It is supported by support posts 11. It will be appreciated that any desirable reference level can be utilised, for example such a line or a reference level provided by a layer of material that has already been laid dawn (and optionally compacted), or a kerb line etc.

The paving machine 1 has a sensor assembly 15 which includes a sensor 17 for sensing the height of the screed relative to a reference level which in this case is provided by the line 10. The sensor 17 has a U-shaped form. The sensor 17 can be of any desired type. It may be contactless for example an ultrasonic sensor, or of a contact type (i.e. contact with the reference level) for example a potentiometer type with an attached adjusting wand. Optionally the sensor 17 is attached to a holding bracket 16. The sensor 17 provides a reference point for a user of the machine so that they can keep the sensor 17 a preferred distance above (and spaced apart from) the line 10. The sensor 17 and the holding bracket 16 are mounted on one end of a rod 18. The sensor 17, the holding bracket 16 and the rod 18 are part of the sensor assembly 15 for attachment to the paving machine 1.

A screed height control system is provided for automatically adjusting the height of the screed 5 in response to different heights sensed by the sensor 17 due to contours of the surface as the machine rooms along in the direction of travel indicated by arrow B.

It will be appreciated that as the machine 1 moves along, the wheels 3 will encounter different irregularities such as undulations etc. in the surface, and as a result the machine 1, and thus also the screed 5 will move relative to the surface. As this would otherwise affect the ability to lay a level layer, the screed 5 is automatically adjusted by the screed height control system to maintain a level layer.

The screed height control system detects changes in the distance between the sensor 17 and the reference line 10 which are due to such movements of the machine, and uses the change in height detected to make an appropriate change to the height of the screed 5. This adjusts the screed 5 to lay a substantially level layer of compactible paving material. Thus as the paving machine 1 moves along, it lays down a layer of compactible paving material that is level in the direction of travel, but which is of varying thickness (depth).

For simplicity in implementing the compaction compensation system of the present invention it is desirable that the screed height control system operates on the principle of maintaining the sensor 17 at a fixed height relative to a reference level.

It is desirable, for simplicity, to have the sensor 17 experience the same relative movement to the underlying surface as the screed 5, because in this way, the screed height control system will better reflect the movement actually experienced by the screed 5(, as distinct from a movement experienced by the rest of the machine.)

While this may be achieved in many ways, in the embodiment, it is achieved by mounting the sensor assembly 15 to a side panel 20 of the screed 5. A mounting bracket 21 is utilised for this purpose.

The sensor assembly 15 is mounted on the screed 5 by an arm 25 which extends forward and is generally parallel to the laying plane of the screed 5. The arm 25 is in turn mounted to mounting bracket 21. It will be appreciated that the sensor assembly 15 is thus (indirectly via arm 25, mounting bracket 21, and side panel 20) mounted to the screed 5.

It will be appreciated then that as the screed 5 is moved up and down using screed arm 7 and two-way ram 8 so too is the sensor assembly 15 and in particular sensor 17. In this way, the screed height control system moves both the sensor 17 and the screed. This means that where the screed height control system controls the distance between the sensor 17 and the reference line 10, then it in effect also controls the screed height relative to the reference line 10. In this way a desirable level of material may be laid down.

The sensor assembly 15 is attached to the screed 5 by a height adjustable mounting 30. This will be described in more detail below.

A surface level detector 40 is provided. The surface level detector 40 is for running along and following the contours of the surface onto which the paving material is to be laid. It includes a wheel 41 mounted by a wheel bracket 42 to a rod 43. The rod 43 is mounted by a (slidable) adjustable mounting bracket 44 to a lever 45.

Figure 2:
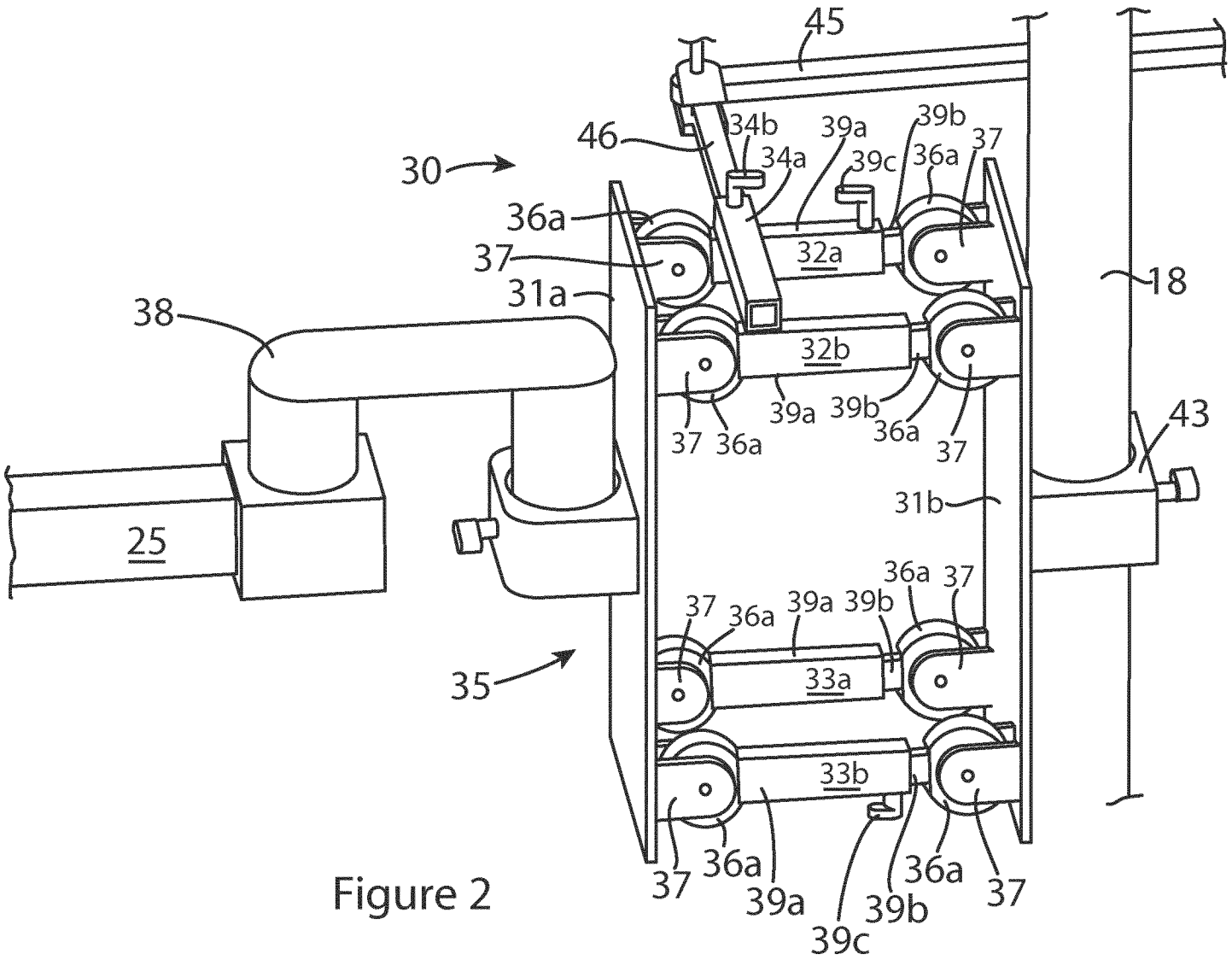
FIG. 2 is an enlarged view of a height adjustable mounting for a sensor which forms part of the compaction compensation system of the invention.

With reference to FIGS. 1 and 2 (but best seen in the enlarged view of FIG. 2) the height adjustable mounting 30 comprises an articulating frame 35. The articulating frame 35 is attached to the lever 45 by a connecting rod 46. The articulating frame 35 comprises a first plate 31*a* and a second plate 31*b*. The plates 31*a*, 31*b* are connected by a pair of upper links 32*a*, 32*b* and a pair of lower links 33*a*, 33*b*. The pair of upper links 32*a*, 32*b* are pivotably attached by (four) pivots 36*a* (which include mounting brackets 37) between the plates 31*a*, 31*b*. The pair of lower links 33*a*, 33*b* are pivotably attached by (four) pivots 36*b* (which include mounting brackets 37) between the plates 31*a*, 31*b*. The connecting rod 46 is fixed to the articulating frame 30 by being attached to both of the upper links 32*a*, 32*b*. A socket part 34*a* is fixed to both of the upper links 32*a*, 32*b* and the connecting rod 46 is slidably received within the socket part 34*a*. A locking key 34*b* can be opened or closed to allow or prevent relative movement of the connecting rod 46 to the socket part 34*a*.

The upper links 32*a* and 32*b* and the lower links 33*a* and 33 each comprise a socket part 39*a* and a rod 39*b*. The rod 39*b* is slidable within the socket part 39*a* for adjustment of the length of the height adjustable mounting 30. A locking key 39*c* is provided on upper link 32*a* and lower link 33*b*. The respective keys 39*c* can be opened or closed to allow or prevent relative movement of the rod 39*b* to the socket part 39*a*. In this way adjustment can be allowed or prevented as desired. The distance between holding plates 31*a* and 31*b* is thus adjustable via extending sliding upper links 32*a* and 32*b* and lower links 33*a* and 33*b*.

The sensor assembly 15 is mounted to the plate 31*b* by a mounting bracket 19. The height adjustable mounting is mounted to the arm 25 by a mounting bracket arrangement 38.

As the paving machine 1 moves along in the direction of arrow B, the wheel 41 which forms part of the surface level detector 40, will move up and down as indicated by arrow D. This in turn (via wheel mounting bracket 42, rod 43 and adjustable bracket 44) moves lever 45 up and down as indicated by arrow E. Movement of the lever 45 in turn moves connecting rod 46. The connecting rod 46 in turn moves the upper links 32*a* and 32*b*. Movement of the upper links 32*a*, 32*b* thus causes articulation of the articulating frame 35 by an amount corresponding to the movement imparted by the connecting rod 46. This causes the sensor 17 to be moved (height adjusted).

It will be appreciated then that movement of the wheel 41 in the direction of arrow D will be transmitted as described above to the articulating frame 30, to impart a desired height adjustment to the sensor assembly 15 and thus the sensor 17. It will be appreciated that the height adjustment is automatically applied as the paving machine 1 moves along.

It will be appreciated that there is attenuation (a proportional decrease) in the displacement of the connecting rod 46 as compared to the movement of the lever 45 at the position of the adjustable bracket 44. This attenuation can be utilised to impart a desired height change to the sensor 15 which represents a compaction compensating factor. For example to set the system of the invention for a 10% compaction factor the height adjustment of the sensor is 10% of the movement of the wheel 41.

It will be appreciated that the relative movement of the sensor can thus be calibrated to represent specific desired compaction factors, e.g. 10%, 11%, 12%, 13% 14% etc. The lever 45 can be calibrated to the relative movement of the sensor 15. Accordingly, pre-set values can be indicated on the machine for example on lever 45. It will be appreciated that as the position of the adjustable bracket 44 can be set at any position along lever 45, the adjustment of the compaction compensation factor is continuously variable. The adjustable bracket 44 may also allow for height adjustment of the surface level detector 40. In particular the rod 43 can be adjusted up and down within adjustable bracket 44 so as to adjust for differing heights of underlying surface.

The actual compensating percentage can be calculated by expressing the distance between the pivot point of pivots 36*a* on the plate 31*a* and the midpoint of holding bracket 19 as a percentage of the distance between pivot point of pivots 36*a* on the plate 31*a* and the axis at the midpoint of the wheel 41 when determined at right angles.

This is because the movement of the sensor 15 depends on its relative location on the lever 45 to the point at which the lever moves in response to surface undulations. The closer it is to the point at which the lever moves in response to surface undulations the greater its relative movement and vice versa.

Accordingly in order to change the relative movement experienced by the sensor 17 all one needs to do is change the relative distance along the lever between the sensor 15 and the point at which the lever is moved in response to surface undulations.

There are two options to do this. One is to change the length of the height adjustable mounting. The other is to change the point at which the lever is moved in response to surface undulations.

In the configuration shown the options to change the compensating percentage include: a) change the point at which the lever is moved in response to surface undulations by moving adjustable bracket 44 in or out along lever 45 leaving the length of the height adjustable mounting constant (the distance between plates 31*a* and 31*b* remains constant or b) leave the point at which the lever is moved in response to surface undulations constant by leaving mounting bracket 44 in a constant position on lever 45 and instead alter the distance between plates 31*a* and 31*b* by adjusting the length of the links 32*a*, 32*b* and 33*a*, 33*b* by sliding the rods 39*b* in sockets 39*a*.

Again the actual compensating percentage can be calculated by expressing the distance between the pivot point of pivots 36*a* on the plate 31*a* and the midpoint of holding bracket 19 as a percentage of the distance between the pivot point of pivots 36*a* on the plate 31*a* and the axis of the midpoint of the wheel 41 determined at right angles.

It will be appreciated that in a system where the screed height control system operates on the principle of maintaining the sensor at a fixed height relative to the reference level, then with a compaction compensating system of the invention which moves the sensor relative to the screed, any adjustment by the screed height control system to maintain the sensor at such a fixed height will automatically include and thus automatically factor in the compaction compensating (height) factor.

Assume that the compactable paving material is compactable by a compaction factor of 10%. The compaction compensating system of the invention will be set so that for any height displacement of the lever 45 (experienced at adjustable bracket 44) the height adjustment experienced by sensor 15 is 10% of that value. This means that the relative displacement of the sensor to the machine is changed by a compaction compensating factor of 10%. So if a 100 mm layer is being laid and this increases a depression in the surface of 20 mm is encountered, then the sensor is moved upwards by 10% of 20 mm which is 2 mm thus the machine will lay a layer of 122 mm in thickness. That is it will lay based on the calculation: (original 100 mm)+(20 mm due to the depression)+(10% of 20 mm as compensation factor for compaction of the extra 20 mm).

Assume for example that where the wheel 41 undergoes a displacement of 20 mm then, assuming again a 10% compaction factor, the amount by which the sensor is moved relative to the screed is 10% of 20 mm i.e. 2 mm is the actual amount of movement based on the compensation factor.

Thus, with a system of the invention, the layer of compactable paving material before compaction will vary in thickness. Also, before compaction that layer will not be entirely level. Instead, the layer will have imparted to it different levels each different level having applied to it a compensating factor to allow for the differential compaction of the different thicknesses of the material being laid down. Overall therefore, after compaction, the layer will be substantially level.

It will be appreciated that the wheel 41 can run directly onto an underlying surface and thus act as the contact point for the surface level detector 40 with the underlying surface.

However in the embodiment shown, and as is preferred, the surface level detector may together with a non-linear compaction adjuster form a non-linear compaction compensation system. The non-linear compaction compensation system is for automatically adjusting the compaction compensation factor based on the thickness of the layer being laid down at a given point in time.

It will be appreciated that the system described above, and in particular in a configuration where the wheel 41 is run directly on an underlying surface, and indeed in U.S. Pat. No. 5,599,134 mentioned above, that once a compaction compensation factor is pre-set into the compaction compensation system then the same compaction factor is applied.

So for example if a compaction compensation system is set to provide a 10% adjustment factor/ratio relative to the thickness of the compatible paving material being laid down, then this percent adjustment factor/ratio will be applied to all compactible paving material until the compaction compensation system is adjusted again to a different adjustment factor/ratio.

The skilled person knows that, even though as a general rule of thumb that a given compactible paving material is compactible by a compaction factor, the issue is that such compaction is non-linear. For example, the compaction is non-linear from the top of the surface of a layer of compactible paving material to the bottom surface thereof. Typically there is a gradient of compaction through a compacted layer. A skilled person would expect the upper part of the layer to be more compacted than a lower part following compaction, because the compaction is applied to the top surface of the layer (typically using a roller) and is transmitted downwards from there through the layer.

This effect may be experienced in two stages. The first may be with the compaction (pre-compaction—for example due to the weight of the screed and/or any tamping/vibration applied by the machine) by the paving machine and the second may be upon further compaction using a roller.

The result is that an upper part of the layer experiences a greater compaction than a lower part. The net result is that even though a given thickness of a given compactible paving material will be compactible by a given factor, there is differential compaction through the thickness of the compactible paving material.

So while the systems described above deal with providing a level surface following compaction taking into account differential compaction based on the thickness of the layer which is varied to compensate for local depressions or high spots, this is done using a fixed or linear relationship between the thickness of the layer and the amount of compaction expected. That is a fixed compaction compensation factor or ratio is used.

However, as mentioned above, there is differential compaction through the layer itself and this means that where a linear/fixed ratio or factor is assumed between the thickness of the layer and the amount of compaction this turns out not to be case.

So while the material is assumed to have a compaction factor of say 10%, one can find that thicker layers can compact by more and thinner layers compact by less than the nominal, say 10%, factor because of non-linear compaction within the material itself. For example a thicker layer that is thicker than a layer which achieves the nominal, say 10%, compaction factor may compact by more, say 12 to 15% and a thinner layer may compact by less, say 6 or 8%. It is clear then that in the end (and even though it is less pronounced) the final compacted material will still have different levels if a fixed compaction compensation factor is used.

And it will be appreciated that depending on the factor by which the material compacts in the first place, and the greater the differences in thicknesses that are laid down, the greater the deviations from a desired level are present in the final compacted surface.

Overall then the same issue arises. Because of the non-linear compaction within a layer the result is that a layer of material will not be level after compaction even if one compensates for different thicknesses of layers laid down to compensate for local deviations such as depressions and high spots.

So there are two clear issues to deal with. The first is achieving a level surface after compaction due to variations such as depressions and high spots. The second is to compensate for non-linear compaction within the layer itself.

Overall then there is still a need to further compensate for this non-linear compaction in differing thicknesses of a layer of compactible paving material.

A compaction compensating system of the invention optionally further includes a non-linear compaction compensation system which compensates for non-linear compaction in differing thicknesses of a layer of compactible paving material.

The non-linear compaction compensation system 60 comprises an inclined surface which in this case is present on a dolly 61. The dolly 61 when employed becomes interacts directly with the surface level detector 40.

The dolly 61 runs on wheels 62. It has a dolly platform 63.

A panel 23 extends overly from the adjustable section 6 of the screed 5. An arm 24 is attached to panel 23 by a bracket 28. The arm 24 extends forwardly (and generally parallel to the paving machine 1). A drawbar 26 is pivotally attached by pivot 29*a* to the towbar 27 and at the opposite end by pivot 29*b* to the dolly 61. So as the machine 1 moves along in the direction of arrow B, the dolly 61 is towed along by the machine and remains under wheel 41. The position of the dolly relative to the paving direction of travel of the paving machine 1 remains constant. Towing of the dolly should not interfere with its ability to follow the underlying surface and for example should not prevent tilting of the dolly (in any direction). For example towing of the dolly should not result in any of its wheels being held aloft if the ground level falls. So a suitable towing mechanism is used. For example a universal joint may be used to allow pivoting to maintain contact with the surface.

On the platform 63 of the dolly 61 is a shaped block 64. It has an upper curvilinear surface 65.

In this arrangement the dolly 61 sits under and supports the wheel 41.

As the paving machine 1 moves along in the direction of arrow B, the dolly 61 is towed along. Its wheels 62 will encounter local deviations in the underlying surface. This in turn will cause the dolly 61 to move upwardly or downwardly as indicated by arrow D. As it does so the wheel 41 which forms part of the surface level detector 40, will also move up and down as indicated by arrow D. As described above this in turn (via wheel mounting bracket 42, rod 43 and adjustable bracket 44) moves lever 45 up and down as indicated by arrow E. Movement of the lever 45 in turn moves connecting rod 46. The connecting rod 46 in turn moves the upper links 32*a* and 32*b*. Movement of the upper links 32*a*, 32*b* thus causes articulation of the articulating frame 35 by an amount corresponding to the movement imparted by the connecting rod 46. This causes the sensor 17 to be moved.

It will be appreciated then that movement of the wheel 41 in the direction of arrow D will be transmitted as described above to the articulating frame 30, to impart a desired height adjustment to the sensor 17. In this way the compaction compensating factor can be imparted to the sensor 17.

It will be also appreciated that as the lever 45 moves up and down the angle of the rod 18 to the dolly 61 changes. As the angle changes the wheel 41 moves fore and aft on the incline of the curvilinear inclined surface 65 as indicated by arrow F.

Thus the height adjustment ultimately transmitted to the sensor 15 is tempered by the movement of the wheel 41 on the curvilinear inclined surface 65 of the dolly 61. This is due to the fact that the wheels movement on the surface results in a partial loss or gain in height depending on whether the wheel is climbing the incline or descending the incline.

And it will be further appreciated that this height adjustment is automatically applied as the paving machine 1 moves along.

When the wheel 41 runs directly on an underlying surface, the movement of the sensor is directly based on the movement of the wheel on the underlying surface. However, once the non-linear compaction compensation system 60 is employed, and in particular in the form with dolly 61, it will be appreciated that there are combined factors at play. The first is the amount of movement (up or down) experienced by the dolly 61. The second is the amount of movement (fore or aft) of the wheel 41 on the curvilinear surface 65. So the resultant height adjustment experienced by the sensor 15 is the aggregate or compound factor of these two movements. It will be appreciated then that the overall compensation factor applied to the sensor is automatically varied as the machine moves and that it is a combination of two factors, a fixed (pre-set) compensating factor and a variable compensation factor.

The curvilinear inclined surface 65 of the dolly 61 imparts a movement to the sensor that reflects the non-linear compaction profile of the compactible paving material.

In use a nominal compaction factor say 10% is applied by using adjustable bracket 44 to position the surface level detector 40 in the required position on lever 45. A desired non-linear compaction profile is imparted to the upper inclined curvilinear surface 65 of the dolly 61. (It will be appreciated that differing blocks 64 with differing surfaces 65 can be employed.)

It will be appreciated that there is then a hybrid compensating factor or ratio in the displacement of the connecting rod 46 lever as compared to the movement of the dolly 61. This hybrid compensating factor or ratio is utilised to impart a desired height change to the sensor 15 which represents a non-linear compaction compensating factor.

Figure 3:
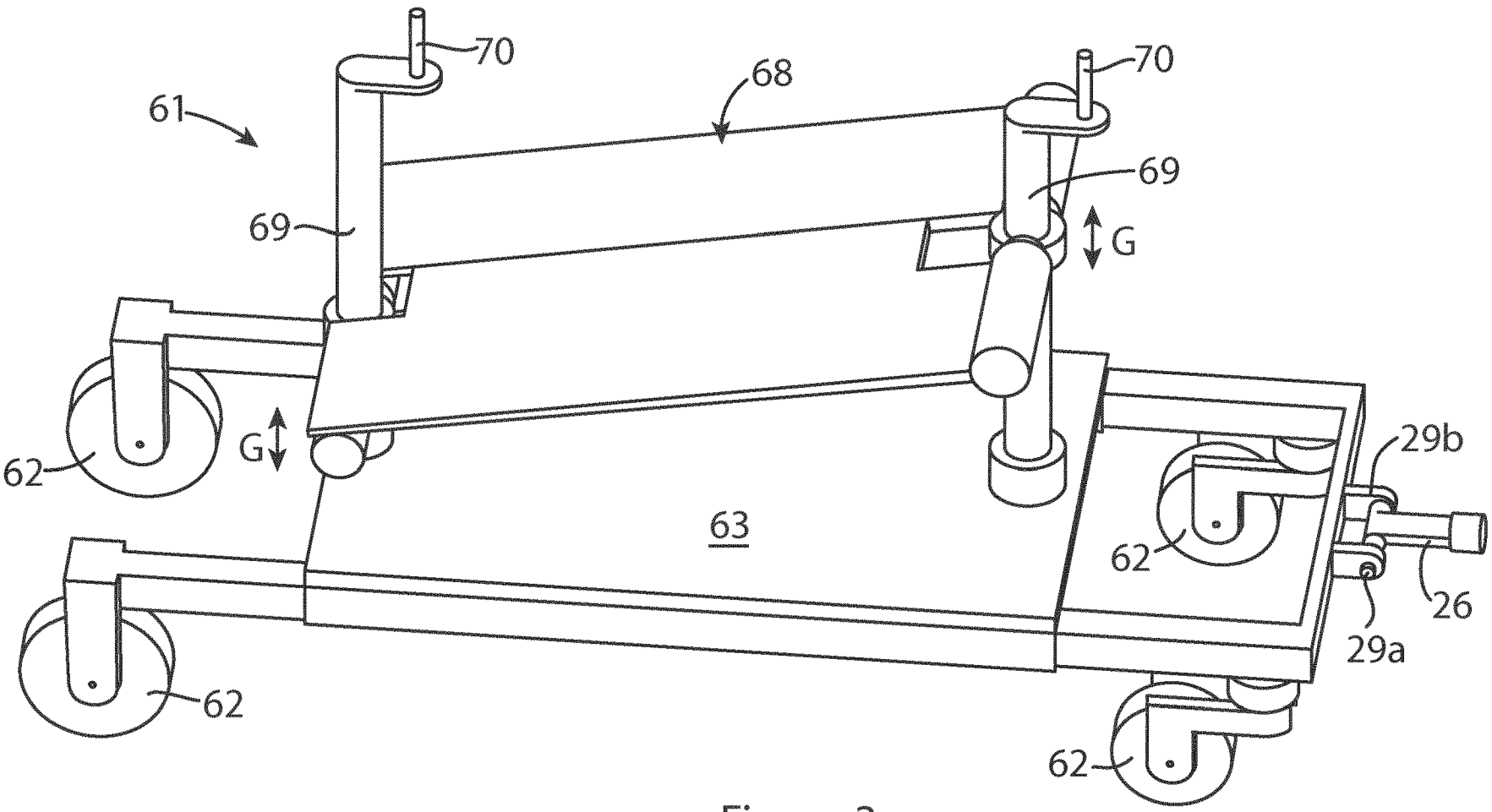
FIG. 3 shows a perspective view of an alternative dolly which forms part of a compaction compensation system of the invention.

FIG. 3 shows a perspective view of an alternative dolly 61. The dolly 61 when employed becomes part of the surface level detector 40.

The dolly 61 runs on wheels 62. It has a dolly platform 63. It operates in the same way (and is attached to the paving machine under wheel 41) as described above for the dolly 61 shown in FIG. 1. The main difference is that on a platform 63 are mounted two height adjustable screw jacks 69. The screw jacks are height adjusted by turning respective handles 70. Adjusting the height of the screw jacks 70 can be used to adjust both the height of and the relative angle (to the ground) of an adjustable slope 68. This means that instead of having a fixed configuration in the dolly 61 such as when a block 64 is utilised, it is instead possible to vary the height and slope of the adjustable slope 68 to a desired extent.

In FIG. 1 the length of the arm 24 can be adjusted in length by opening a locking screw 47 which allows a forward part 24*b* of the arm 24 to slide (forwardly and rearwardly) within a rear part 24*a* of arm 24. Part 24*a* of arm 24 is inserted into forward part 24*b* at mouth 24*c* (of forward part 24*b*) and is slideably received therein. The position of the dolly 61 relative to the surface level detector and/or the sensor can thus be selected as the length of the arm 24 can be adjusted as desired. The adjustment of the arm 24 can in turn be used to change the height and/or slope experienced by the surface level detector. For example in the embodiment of FIG. 1 having the wheel 41 run on different parts of the upper surface 65 will vary the height and slope experienced by the surface level detector. For example in the embodiment of FIG. 3 having the wheel 41 run on different parts of the slope 68 will vary the height experienced by the surface level detector.

Figure 4:
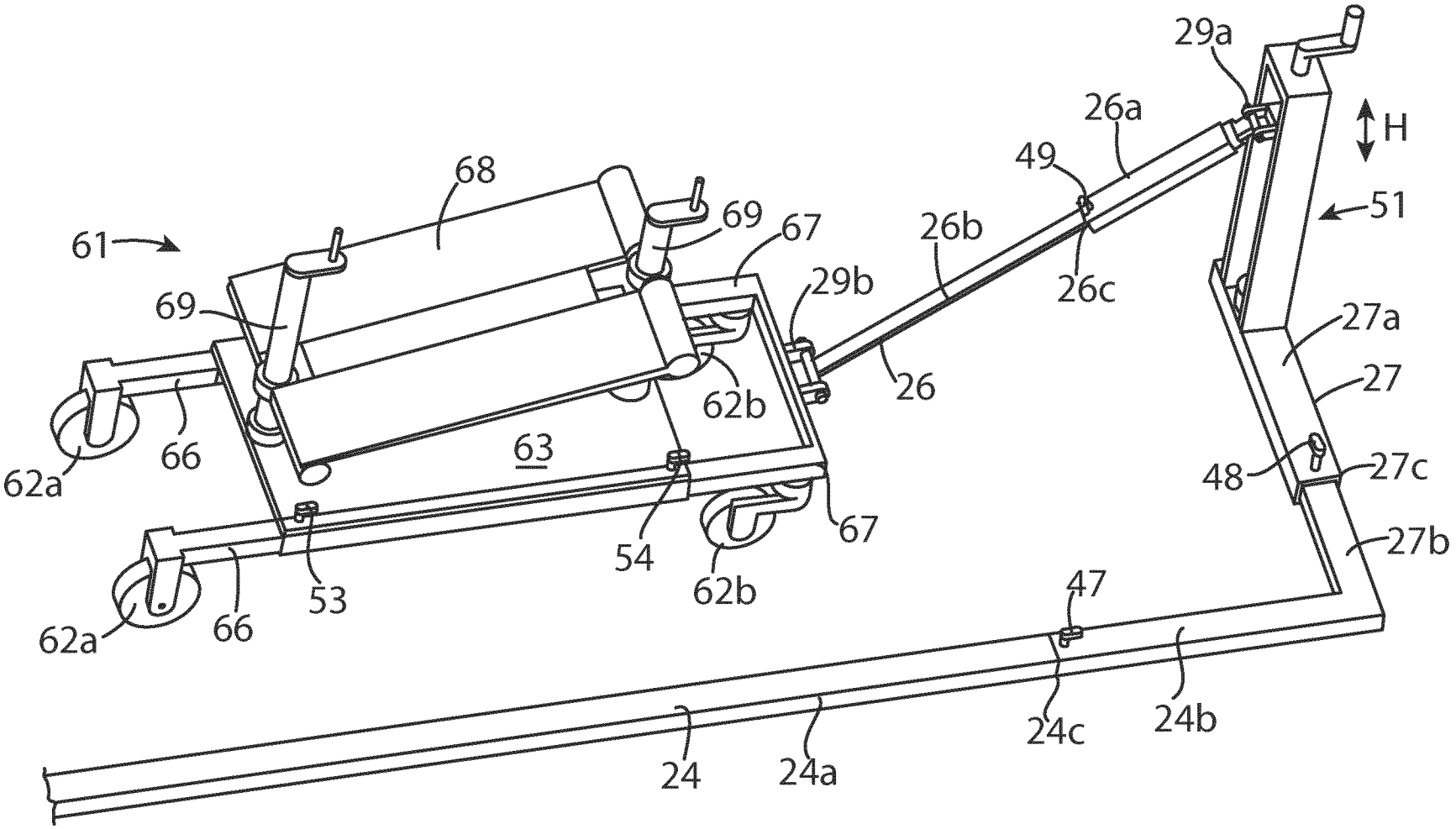
FIG. 4 shows a perspective view of a dolly similar to that of FIG. 3 which forms part of a compaction compensation system of the invention, with an alternative drawbar arrangement.

FIG. 4 shows a perspective view of a dolly 61 similar to that of FIG. 3 which forms part of a compaction compensation system of the invention, with an alternative towbar arrangement. In this arrangement, and as described in relation to FIG. 3 the arm 24 can be extended by opening a locking screw 47 which allows a forward part 24*b* of the arm 24 to slide within a rear part 24*a* of arm 24. Part 24*a* of arm 24 is inserted into forward part 24*b* at mouth 24*c* (of forward part 24*b*) and is slideably received therein.

Again the adjustment of the arm 24 can in turn can be used to change the height and/or slope experienced by the surface level detector. For example in the embodiment of FIG. 1 having the wheel 41 run on different parts of the upper surface 65 will vary the height and slope experienced by the surface level detector. For example in the embodiment of FIG. 3 having the wheel 41 run on different parts of the slope 68 will vary the height experienced by the surface level detector.

The drawbar 26 can be adjusted in length by opening a locking screw 49 which allows a rear part 26*b* of the drawbar 26 to slide (forwardly or rearwardly) within a forward part 26*a* of arm 26. Part 26*b* of arm 26 is inserted into forward part 26*a* at mouth 26*c* (of forward part 26*a*) and is slideably received therein. The adjustment of the drawbar 26 can in turn can be used to change the height and/or slope experienced by the surface level detector. For example in the embodiment of FIG. 1 having the wheel 41 run on different parts of the upper surface 65 will vary the height and slope experienced by the surface level detector. For example in the embodiment of FIG. 3 having the wheel 41 run on different parts of the slope 68 will vary the height experienced by the surface level detector.

The drawbar 26 is pivotally attached by pivot 29*a* to the towbar 27 and at the opposite end by pivot 29*b* to the dolly 61. In the embodiment shown the attachment of the drawbar 26 to the towbar 27 is via a screw jack 51 which allows height adjustment of the drawbar 26 relative to the towbar 27 as indicated by arrow H. It will be appreciated that increasing the height will move the dolly forward relative to the surface level detector and/or sensor. So the height adjustment of the drawbar 26 can in turn can be used to change the height and/or slope experienced by the surface level detector. For example in the embodiment of FIG. 1 having the wheel 41 run on different parts of the upper surface 65 will vary the height and slope experienced by the surface level detector. For example in the embodiment of FIG. 3 having the wheel 41 run on different parts of the slope 68 will vary the height experienced by the surface level detector.

The towbar 27 is adjustable and a locking screw 48 which allows a first part 27*b* of the arm 27 to slide within a second part 27*a* of arm 27. Part 27*b* of arm 27 is inserted into first part 27*a* at mouth 27*c* (of first part 27*a*) and is slideably received therein. This allows a user to choose how close (lateral distance) the dolly 61 runs relative to the remainder of the machine (in the direction of travel), for example wheels 3 of the paving machine 1. So the length adjustment of the towbar 27 can in turn can be used to change the height and/or slope experienced by the surface level detector. For example in the embodiment of FIG. 1 having the wheel 41 run on different parts of the upper surface 65 will vary the height and slope experienced by the surface level detector. For example in the embodiment of FIG. 3 having the wheel 41 run on different parts of the slope 68 will vary the height experienced by the surface level detector.

The wheelbase of the dolly 61 is also (length) adjustable. Rear wheels 62*a* are mounted on a rear chassis part 66. Forward wheels 62*b* are mounted on a forward chassis part 67. The rear chassis part is slidable relative to the remainder of the dolly 61, for example relative to the platform 63. A locking screw 53 locks the rear chassis part 66 in a desired position. In an analogous manner the forward chassis part is slidable relative to the remainder of the dolly 61, for example relative to the platform 63. A locking screw 54 locks the forward chassis part 67 in a desired position. It will be appreciated that by adjusting the position of either or both of the forward and rear chassis parts 66, 67 relative to the remainder of the dolly 61 the wheel base can be adjusted.

Adjusting the wheelbase allows the dolly to more closely follow (lesser averaging of contours) the underlying surface such as when the wheelbase is relatively shorter, or to better average out the contours of the underlying surface such as when the wheelbase is relatively longer.

Figure 5:
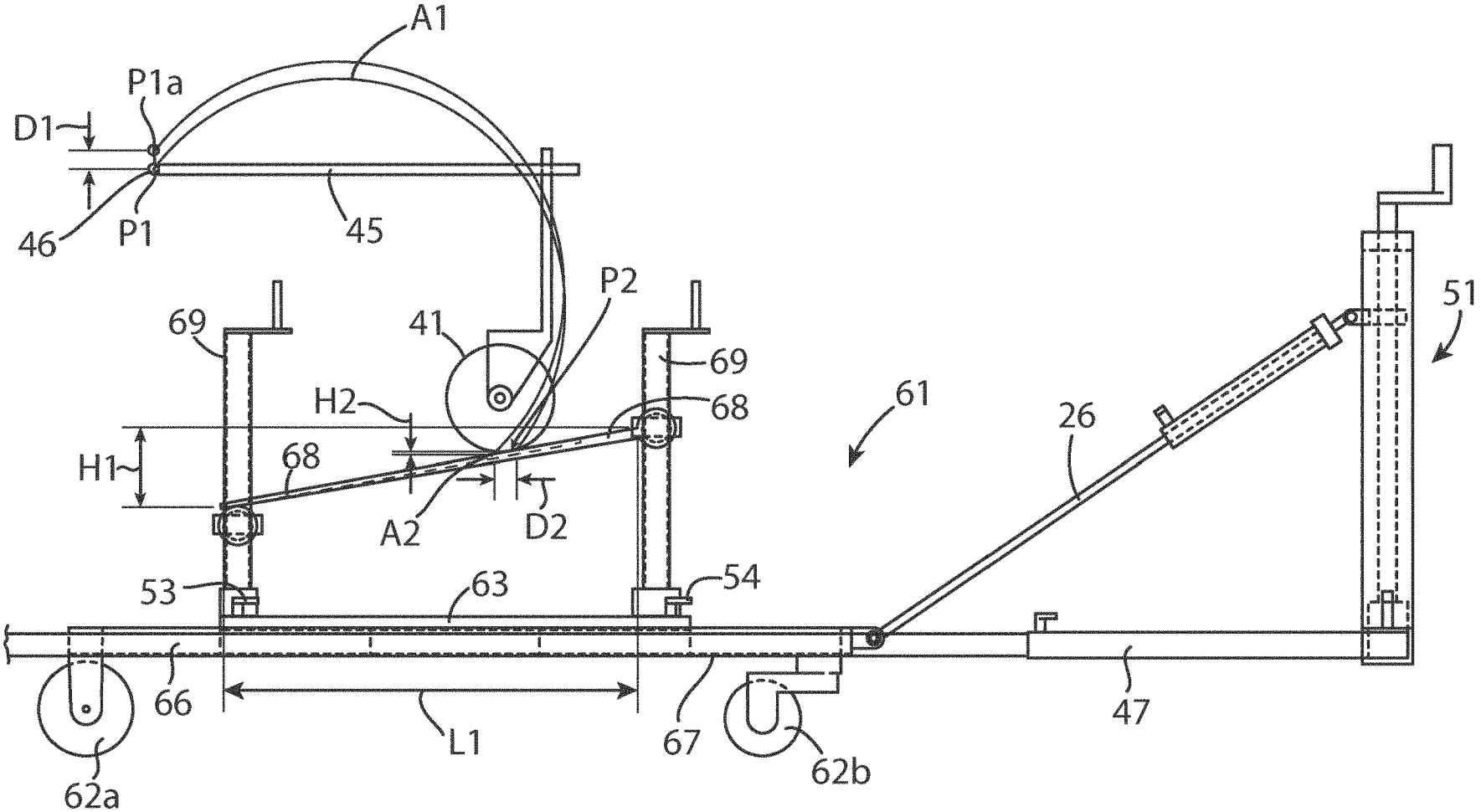
FIG. 5 is a side view of the dolly and drawbar arrangement of FIG. 4 showing schematically how adjustments can be made.
Figure 6:
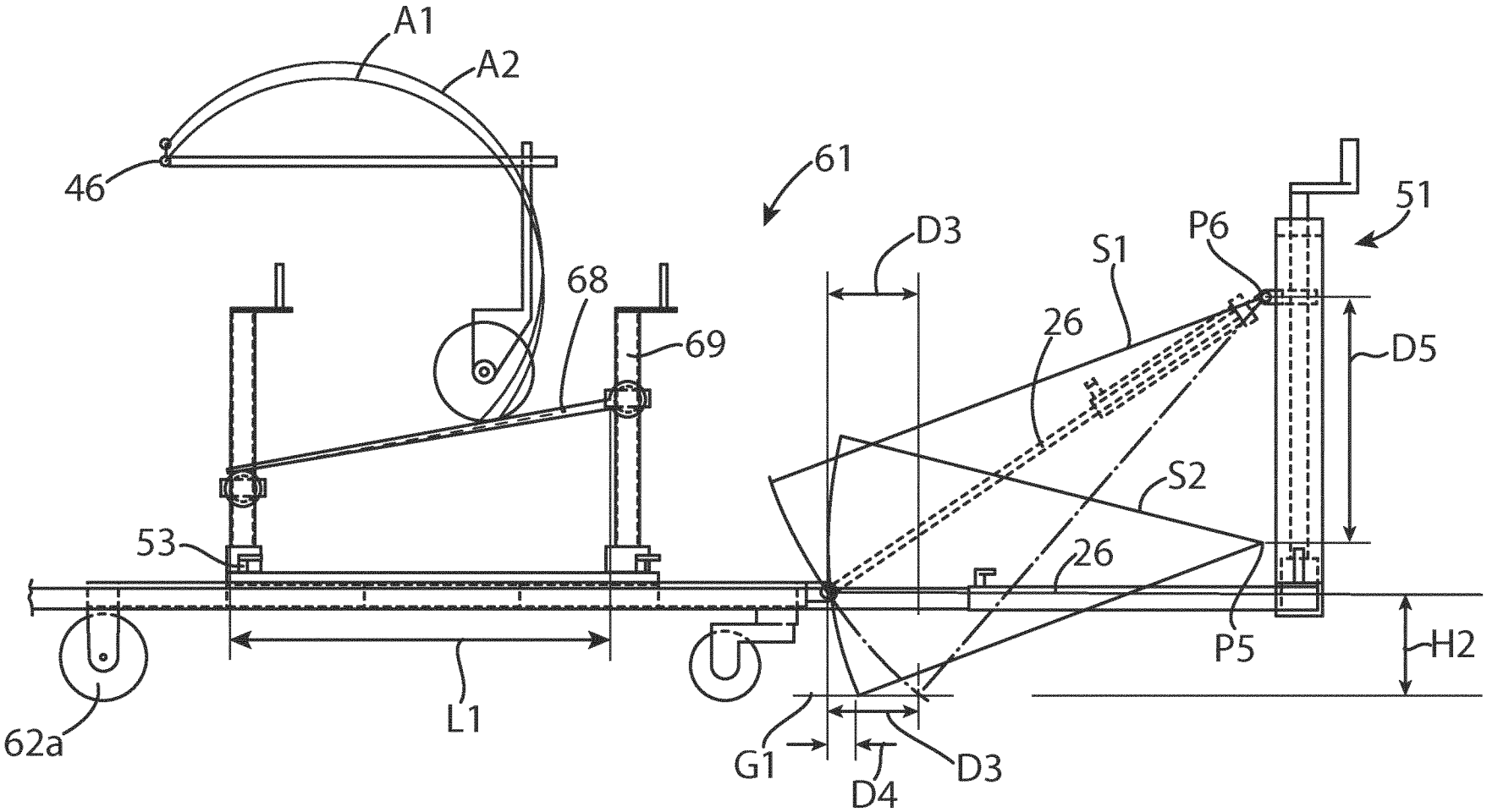
FIG. 6 is a side view of the dolly and drawbar arrangement of FIG. 4 showing schematically how adjustments can be made.

FIG. 5 is a side view of the dolly and drawbar arrangement of FIG. 4 showing schematically how adjustments are made and effect change in the compaction compensation system; and FIG. 6 is a side view of the dolly and drawbar arrangement of FIG. 4 also showing schematically how adjustments are made and effect change in the compaction compensation system.

It is appreciated that where the surface level detector is connected to a lever and thus moves about a fulcrum, that the movement of the surface level detector up and down will also involve fore and aft movement which will follow the arc of a circle. It is understood that any adjustment that changes the distance between the surface level detector and the fulcrum of the lever to which it is connected will result in fore and aft movement which will follow different arcs.

In FIG. 5 some measurements etc. are given to explain the operation of the compaction compensation system. The compaction compensation system is set to apply a compaction compensation factor which for the purposes of discussion will be assumed to be 20%.

The fulcrum point of the lever 45, (which is taken to be the position it is connected to the connecting rod 46) is at position P1.

The position of the wheel 41 (on the dolly 61) is indicated as P2.

Now assume that the paving machine 1 drives into a depression that is 100 mm deep. This will in turn bring the sensor (not shown in FIG. 5) closer to the desired reference level by an amount of 100 mm. The screed control system then starts to move the screed to compensate for the depression. Without the compaction control system of the invention the screed control system would move the screed to add 100 mm to the depth (thickness) of the material being laid so as to maintain a constant level of the material.

However as the screed control system starts to move the compaction compensation system of the invention operates. Again assuming that the lever 45 is set to apply a 20% compaction compensation ratio, then the sensor would be raised a further 20 mm (20% of 100 mm) as illustrated by the arrows labelled D1. This is how the system would operate if the wheel 41 ran along the surface on which the material is applied (i.e. if the dolly 61 were not in use).

However once again there is a further factor to consider. That factor is the relative movement of the wheel 41 on the dolly 61. As the screed control system operates and the fulcrum point of the lever 45 (, which again is taken to be the position it is connected to the connecting rod 46) moves—it starts at position P1 and moves (upward) to position P1*a* (by an amount of 20 mm). This in turn changes the arc of movement of the wheel 41 from arc A1 to arc A2. The wheel 41 then rolls (backwards down the slope 68) by a distance D2 which in the embodiment is indicated as 23.86 mm.

In this case the slope 68 is constant and the inclination of the slope can be calculated as the height of the slope divided by its length which in the embodiment is shown as (H1) 83.85/L1 (442.12). The inventor chooses to express this inclination as a percentage which in this calculation is 18.965%.

To calculate the (vertical) drop in height of the wheel 41 (as indicated by arrows H2) then, one can assume the wheel falls by 18.965% of 23.86 mm which is 4.525 mm.

Because the wheel 41 is attached to the lever 45 at a position relative to the fulcrum 46 that imparts a (an assumed 20%) compensation factor it will be appreciated that as the wheel 41 falls by 4.525 mm this causes the distance D1 to be further adjusted by 20% of 4.525 mm or approximately a further 0.906 mm. to a total adjustment of approximately 5.4 mm (4.525 mm+0.906 mm=5.431 mm).

This amount is the amount that the screed control system will experience and be the amount by which it adjusts. It will thus be appreciated that the compaction compensation factor once set is nonetheless being dynamically adjusted by the system of the invention.

It will be appreciated that as the screed control system adjusts to include this further 0.906 mm this may cause the wheel 41 to fall a further 18.965% (due to the slope) of 0.906 mm. The result then is that the wheel 41 will fall by a further 0.906×18.965%=0.172 mm and this in turn will have the 20% compensation factor applied. Because this is such a small measurement out of the overall depth being laid, this further measurement will be ignored for the purposes of the calculation.

Overall then for the 100 mm drop in height due to the depression the pre-set compensation factor of 20% applies a 20 mm correction. The mechanism for automatically adjusting the compaction compensation factor applies an adjustment of a further 4.525+0.906+0.172=5.603 mm. So in total the adjustment is 25.6 mm to compensate for the 100 mm depression at a compaction factor of 20%. So the screed is adjusted by 125.6 mm. The compaction compensation factor has thus been dynamically changed from 20% to 25.6% using the system of the invention (rounding to one decimal place).

In essence then, and rounding off the numbers calculated above, the slope 68 on the dolly 61 adds or subtracts 1% to the (pre-set) compensation factor of 20% for every 18 mm variance in depth to be laid. So in the example above the compaction compensation factor has changed from 20% to approximately 25.6%.

It will be appreciated that this is one example and the system of the invention can be adjusted, for example pre-set, for an expected compaction compensation factor and for expected variance in that based on the material and amount (depth) of it being laid.

Thus in effect the compaction ratio varies based on depth of material being laid and this can be used to adjust to apply a non-constant or non-linear compaction compensation factor.

So there is a dynamic relationship within the compaction compensation system of the invention and within the screed height control system between the mechanism for automatically adjusting the compaction compensation factor based on the thickness of the layer being laid down at a given point in time and the mechanism for automatically height adjusting the height adjustable mounting so as to height adjust the sensor relative to the screed. So even though there is a dynamic relationship it will result in equilibrium.

It will be appreciated that an overall compaction compensation factor is (automatically and dynamically) fed into the screed control system and is (automatically and dynamically) adjusted by an overall compaction compensation factor which is a cumulative compaction compensation factor based on a combination of:

(i) a detected change in the height of surface on which the material is being laid;

(ii) a pre-set compaction compensation factor; and (iii) an (automatic) adjustment of the compaction compensation factor.

Thus the position of the screed is (automatically) adjusted by an overall compaction compensation factor (thus taking into account (i) to (iii) as set out above). The compensation compaction factor is non-linear—it varies depending on the depth.

In FIG. 6 other adjustments that can be made are illustrated schematically. For example FIG. 6 demonstrates how altering the tow point can change the calculations. In the calculations above it was assumed that the tow point was assumed to be substantially parallel to the ground over which it passes, and at a substantially constant height.

In FIG. 6 the dolly 61 is firstly assumed to be towed at tow point P6—in this position it is shown in dashed outline. (It will be appreciated that the tow point of the drawbar 26 is adjustable by virtue of screw jack 51). It is assumed to encounter a depression of height H2 from (depressed) ground level G1. In the embodiment H2 is 117.71 mm. Because of the angle of the drawbar 26 (to the horizontal axis of the dolly 61) and due to movement up and down (over undulations in the surface) the drawbar 26 will sweep out a movement which in the embodiment is schematically shown as a (geometric) sector S1.

Upon hitting a depression of height H2, and because of the angle of the drawbar, the dolly 61 will move forward by an amount D3 which in the embodiment is 103.92 mm.

For the purposes of FIG. 6 the slope 68 is assumed to be the same as in FIG. 5 i.e. 18.965% and the compensation compaction factor is assumed to be the same at 20%.

Had the depression been 100 mm the movement of the dolly 61 forward would be 103.92 mm/117.71 mm×100 mm=88.28 mm. Because the inclination is 18.965% the wheel 41 will fall 88.28×18.965%=16.74 mm. The compaction compensation factor of 20% is applied to that so 16.74×20%=3.348 mm. Because this is a relatively large amount we apply a further 20% compensation factor to that correction which is 3.348×20%=0.670 mm giving a value of 16.74+3.348+0.67=20.76 mm. (Again the remaining increasingly smaller changes while the system reaches equilibrium are ignored).

So overall then the 20.76 mm out of 100 mm is 20.76%. So the tow-point system will apply a further overall 20.76% variance to the compaction compensation factor of 20% bringing the cumulative compaction compensation factor to 25.6%+20.76%=46.36% in this case. In essence then, and to the nearest decimal point, the system with the above parameters adds about 6.6% to the (pre-set) compensation factor of 20% for every 25 mm variance in depth to be laid.

The dolly 61 is now assumed to be towed at tow point P5 (—it is not shown in this position). (Again it will be appreciated that the tow point of the drawbar 26 is adjustable by virtue of screw jack 51 and this tow-point is 281.60 mm (see distance D5) lower than tow-point P6). It is again assumed to encounter a depression of height H2 from (depressed) ground level G1. In the embodiment H2 is 117.71 mm. Because of the angle of the drawbar 26 (to the horizontal axis of the dolly 61—in this case it is parallel)) and due to movement up and down (over undulations in the surface) the drawbar 26 will sweep out a movement which in the embodiment is schematically shown as a (geometric) sector S2.

Upon hitting the depression of height H2, and because of the angle of the drawbar, the dolly 61 will move forward by an amount D4 which in the embodiment is 31.99 mm. (This is 103.92−31.99=71.93 mm less than when the tow-point was 281.60 mm higher at tow-point P6.)

Again the slope 68 is the same as in FIG. 5 i.e. 18.965% and the compensation compaction factor is the same at 20%.

Had the depression been 100 mm the movement of the dolly 61 forward would be 31.99 mm/117.71 mm×100 mm=27.18 mm. Because the inclination is 18.965% the wheel 41 will fall 27.18×18.965%=5.15 mm. The compaction compensation factor of 20% is applied giving 5.15×20%=1.03 mm. 1.03×20%=0.206 mm so ignoring subsequent minor dynamics we get 5.15+1.03+0.206=6.386 mm to that so the final value is 6.39 mm which expressed as a % of 100 mm is a 6.39% change. (Again the small change while the system reaches equilibrium is ignored).

So overall then the cumulative compaction compensation factor changes from an original 20% to 25.6 (Dolly effect)+6.39 (tow-point effect)=31.99%. So again lowering the tow point by 281.60 mm had the effect of lowering the compaction factor from 46.36% to 31.99% a change of 14.37% equivalent to a 1% change every 19.6 mm moved.

Figure 7:
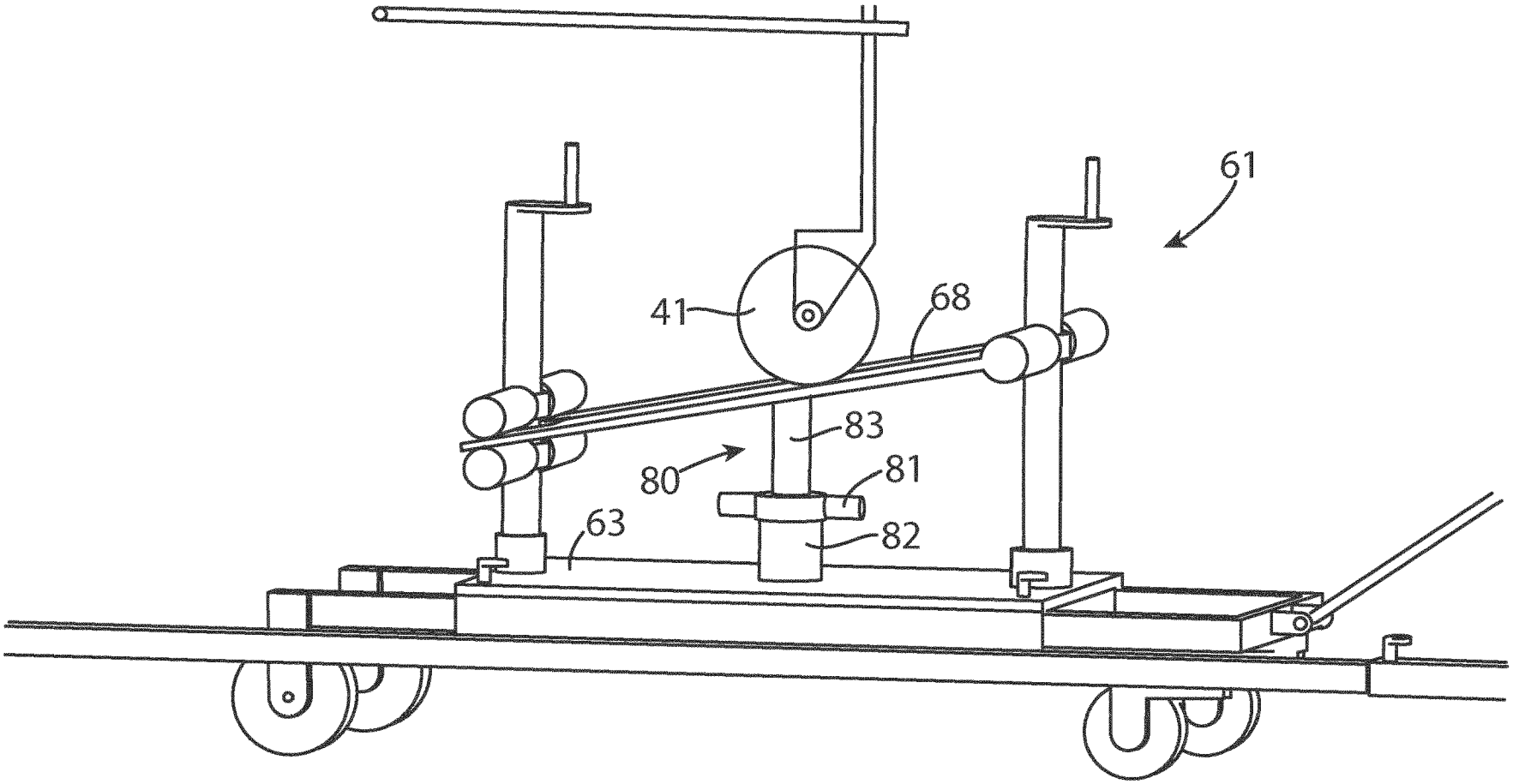
FIG. 7 shows a perspective view of a dolly similar to that of FIGS. 3 to 6 with a slope adjustment mechanism.

FIG. 7 shows a perspective view of a dolly similar to that of FIGS. 3 to 6 with a slope adjustment mechanism. The slope adjustment mechanism 80 shown comprises a support 82 which attaches it to the dolly 61 and in particular platform 63. A twistable collar or lug 81 is used to extend or retract a jack 83. The jack 83 is attached to the slope 68. In this embodiment the slope 68 can flex. The slope adjustment mechanism can then be used to push up on or pull down on the slope 68. It will be appreciated that in this way a depression or raised part can be imparted to the slope 68. For example a curvilinear form can be imparted to slope 68. Having a non-linear slope will allow for automatically adjusting the compaction compensation factor in a non-linear way. This can be desirable to better reflect the compactible nature of the material being laid and in turn allow for better (automatic) adjustment of the compaction compensation factor by imparting an adjustment to the compaction compensation factor which better replicates the compaction profile of the material. It will be appreciated that multiple slope adjustment mechanisms can be used to achieve any desired shape/slope.

Figure 8:
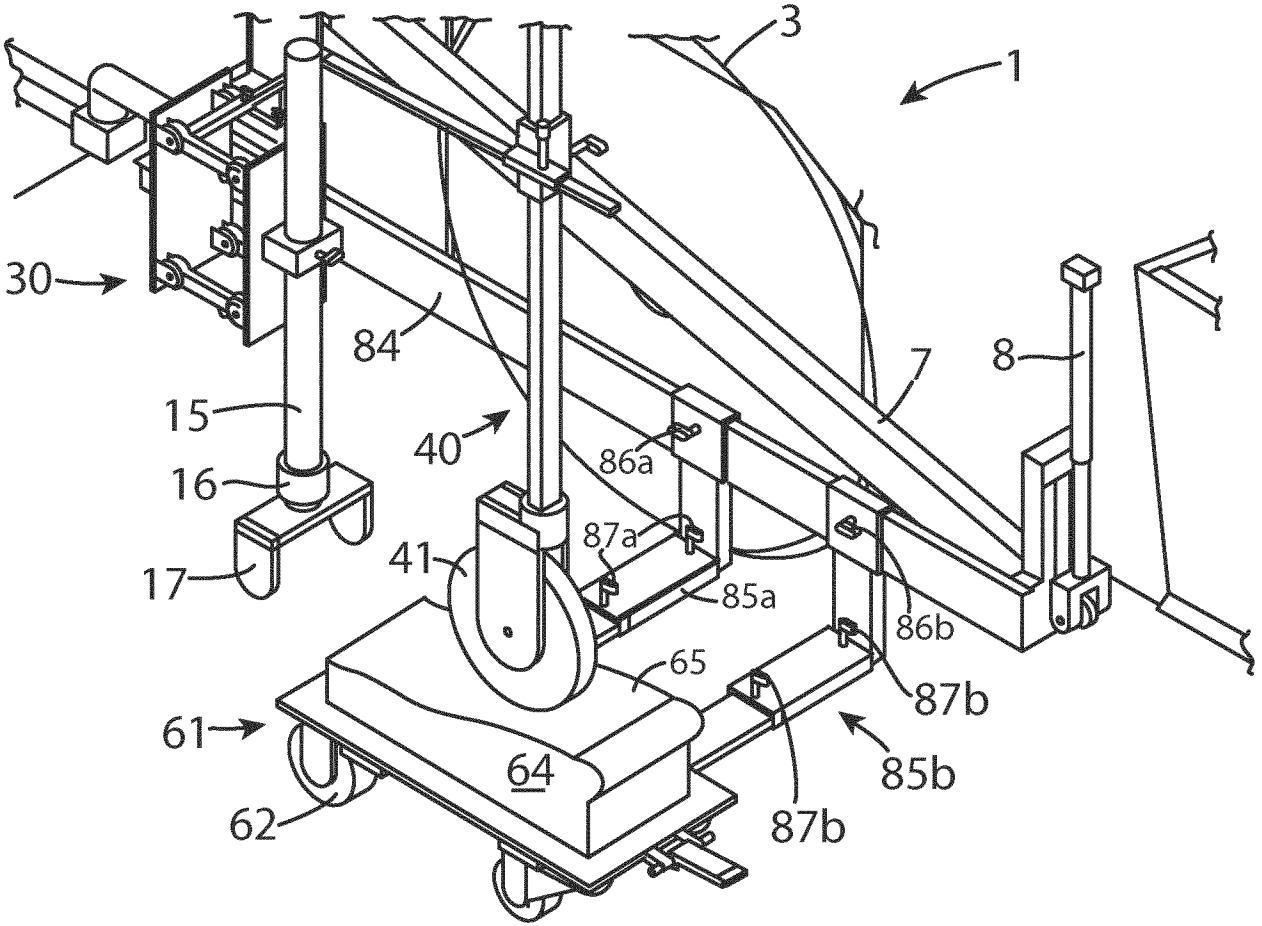
FIG. 8 is a perspective view of an alternative compaction compensation system of the invention attached to a paver.
Figure 9:
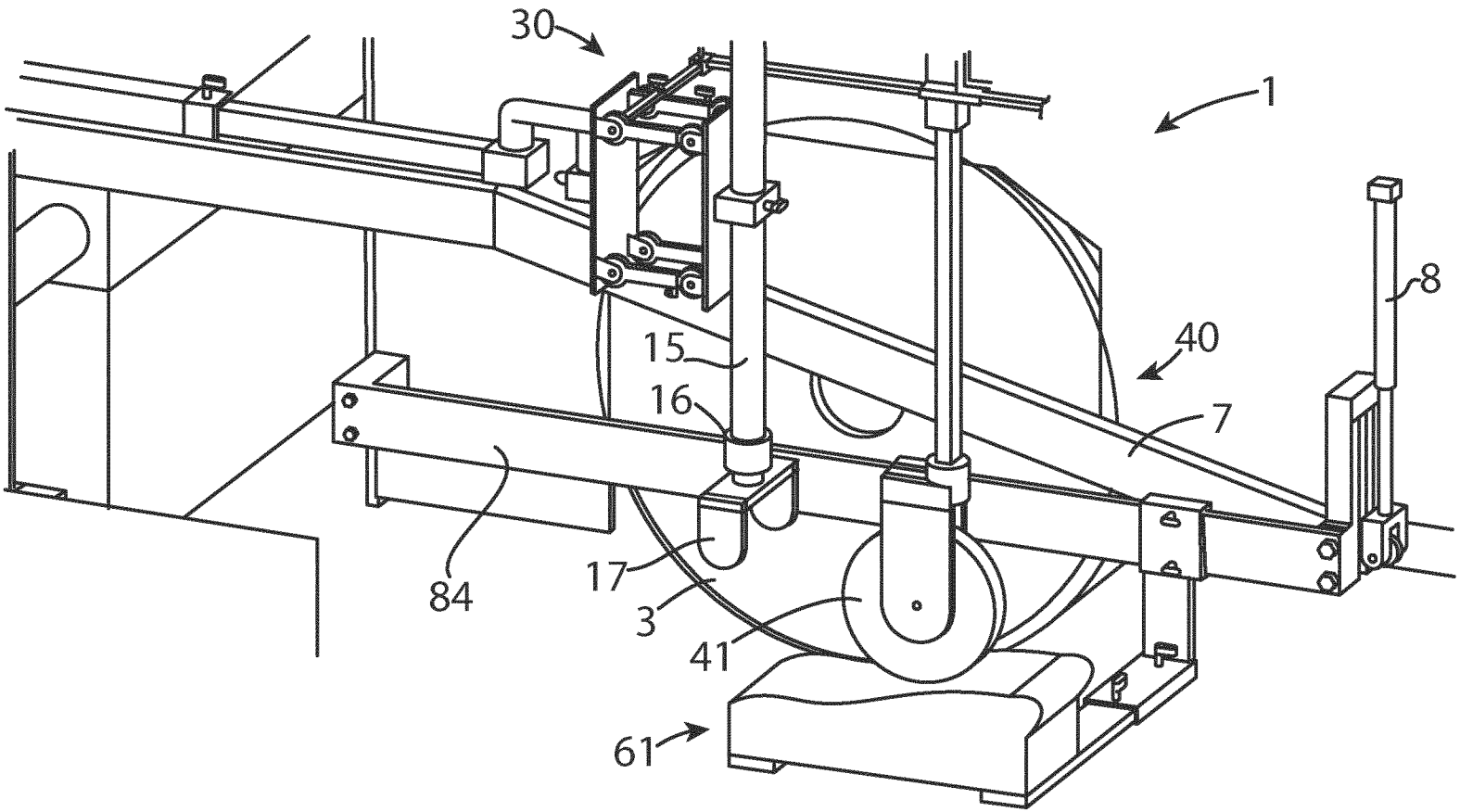
FIG. 9 is a perspective view of an alternative compaction compensation system of the invention very similar to that of FIG. 8 attached to a paver.

FIG. 8 is a perspective view of an alternative compaction compensation system of the invention attached to a paver 1 and FIG. 9 is a perspective view of the same compaction compensation system as that of FIG. 8 save that the dolly 61 has no wheels (62 in FIG. 8). It will be appreciated (and as described in more detail below) that the wheels 62 shown in FIG. 8 may be redundant. (However, it could be useful to retain the wheels in case that the user wishes to revert to a system as described in earlier embodiments where the dolly 61 is not held aloft by the paving machine but instead separately and independently runs along the surface itself.)

The main difference between the embodiment shown in FIGS. 8 and 9 and earlier embodiments is the fact that the wheels 3 of the paver are in effect the surface level detector.

In earlier embodiments, and in general, it is desirable that the surface level detector is independent of the paving machine 1 in the sense that it independently contacts the underlying surface and moves in response to changes in the surface.

However, an alternative arrangement is shown in FIGS. 8 and 9 where in effect the compaction compensation system of the invention is carried by the paving machine 1. Instead of the surface level detector responding to changes in the surface which are encountered and transmitted by the wheels 62 (on dolly 61), now instead the compaction compensation system is carried by the paver 1. Accordingly when the wheels 3 of the paving machine 1 encounter changes in the surface, these will be transmitted to the sensor and this will result in the sensor 17 moving with respect to the reference level.

This in turn causes the screed arm 7 to move, and a compaction compensation factor is applied by the height adjustment mechanism 30 height adjusting the sensor 17 as described previously.

The dolly 61 is carried on two arms 85*a*, 85*b*. The arms 85*a* and 85*b* are carried by on a rail arm 84 which is fixed and does not move relative to the paving machine 1. The relative position of the arms 85*a*, 85*b* are adjustable on the rail arm 84 by using locking screws 86*a*, 86*b*. The arms 85*a* and 85*b* are length adjustable by adjusting the length of arms using 85*a* 85*b* using locking screws 87*a* and 87*b*. In the embodiment the wheels 62 are held aloft of the underlying surface and accordingly, the relative movement of the sensor 17 to the reference level is due to movement of the paver itself. The wheels 62 are thus redundant and can be omitted as shown in FIG. 9.

When the rail arm 84 moves (in response to the movement of the wheels 3 of the paving machine 1,) movement of the wheel 41 on the upper surface 65 of a block 64 on the dolly 61 occurs. It will thus be appreciated that in common with the earlier embodiments the compaction compensation factor is applied by virtue of height adjusting the sensor 17 using the height adjustable mounting 30 as previously described. It will also be appreciated that the compaction compensation factor is also dynamically adjusted by virtue of movement of the wheel 41 on the surface 65 as described previously.

In this way instead of having a surface runner that independently runs along the surface, instead, the wheels of the paving machine itself act as the surface runner. In this respect it is noted that the term "wheels" refers to any suitable ground engaging means on which the paving machine travels, for example wheels, rollers, tracks etc.

The arrangement shown may be suitable for laying down materials where a gradual build-up of the substructure has taken place and where the compaction compensation factor is used to achieve tighter tolerances. For example tighter tolerances may be required as the construction progresses through various layers, for example reaching the final wearing course layer on which is to be trafficked.

Figure 10:
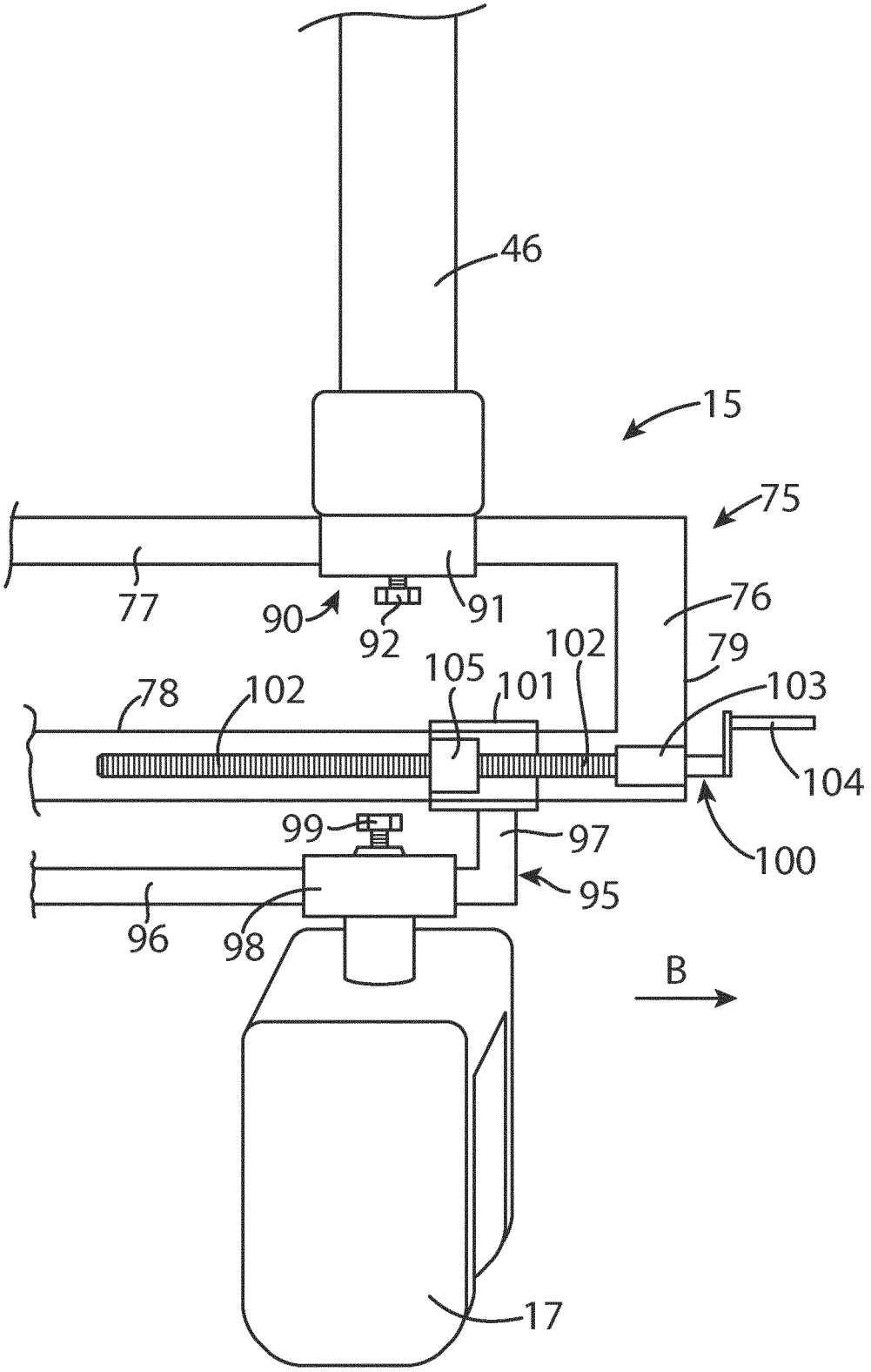
FIG. 10 is a perspective view of an alternative sensor assembly for use with any embodiment of the invention.

FIG. 10 is a perspective view of an alternative sensor assembly 15 for use with any embodiment of the invention. The sensor assembly 15 has a sensor 17 as described above. The sensor assembly 15 is attached to the screed 5 by a height adjustable mounting 30 as described above. In this arrangement the sensor assembly 15 is attached via a connecting rod 46 to the articulating frame 35 as described above. For the purposes of illustration only the connecting rod 46 is shown.

The position of the sensor 17 is further adjustable by an adjustable mounting 75 which can be used to adjust the position of the sensor 17 relative to the direction of travel as indicated by arrow B. (It will be appreciated that the sensor 17 can be moved in the same direction as arrow B points or in the opposite direction.)

The adjustable mounting 75 allows the position of the sensor head 17 to be moved forward or backward relative to the machine so this changes the distance of the sensor 17 from the connecting rod 46 and in turn then changes the position of the sensor 17 relative to the lever 45. Accordingly changing the position of the sensor 17 using the adjustable mounting 75 allows for change in the compensation factor applied.

The adjustable mounting 75 comprises a u-shaped mounting bracket 76 which has two parallel arms 77,78 and a base portion 79 bridging the two parallel arms. One arms 77 is held to the connecting rod 46 by an adjusting bracket 90 which has a bracket 91 and a locking bolt 92. When the locking bolt 92 is loosened the arm 77 can be slidingly adjusted by sliding within bracket 91. When the desired position is achieved the locking bolt 92 can be tightened to secure the position.

A further bracket 95 is provided which supports the sensor 17. In particular the bracket 95 has an arm 96 to which the sensor 17 is secured by a mounting bracket 98. When a locking bolt 99 is loosened the bracket 98 can be slidingly adjusted along arm 96. The locking bolt 99 can be tightened to retain the sensor 17 in a desired position.

A second arm 97 of the bracket 95 is attached via an adjustment mechanism 100. A bracket 101 is attached to arm 97. The bracket 101 can slide along arm 78. The bracket 101 is connected to a carriage 105. The carriage 105 is in turn mounted on a threaded rod 102 which passes through the carriage 105 and a mounting bracket 103. A turning handle 104 is provided. As the handle 104 is rotated the threaded rod 102 in turn rotates. The rotation of the threaded rod 102 in turn causes the carriage 105 to move along the threaded rod carrying with it the bracket 95 and thus the sensor 17. Accordingly sensor 17 can be advanced and retracted by winding the handle 104 in opposing directions.

The words "comprises/comprising" and the words "having/including" when used herein with reference to the present invention are used to specify the presence of stated features, integers, steps or components but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A compactible layer paving material compaction compensation apparatus comprising:

a paving machine sensor detecting a height of a paving machine screed in relation to a reference level; and an automatic sensor height adjustment mechanism wherein the automatic sensor height adjustment mechanism varies a height of the paving machine sensor in relation to the height of the paving machine screed by a compaction compensating factor, wherein the compaction compensating factor is a function of a thickness of a layer of a paving material laid down by a paving machine.

2. The compactible layer paving material compaction compensation apparatus according to claim 1 further comprising a mechanism for automatically adjusting the compaction compensation factor based on the thickness of the layer being laid down in real time.

3. The compactible layer paving material compaction compensation apparatus according to claim 1 further comprising a paving machine screed height control system for automatically adjusting a height of the paving machine screed in response to different heights sensed by the paving machine sensor due to contours of a surface onto which a paving material is to be laid, wherein the paving machine screed height control system for automatically adjusting the height of the paving machine screed in response to different heights sensed by the paving machine sensor adjusts the paving screed to lay a layer of varying thickness and maintains the paving machine sensor at a fixed height from a reference level.

4. The compactible layer paving material compaction compensation apparatus according to claim 1 wherein the paving machine sensor is a contactless sensor.

5. The compactible layer paving material compaction compensation apparatus according to claim 1 further comprising a surface level detector for detecting changes in the contours of the surface onto which the paving material is to be laid.

6. The compactible layer paving material compaction compensation apparatus according to claim 5 wherein the paving machine sensor is attached to the paving machine screed by a height adjustable mounting and the surface level detector is a surface runner, wherein the surface runner moves relative to the paving machine in response to changes in the contours of the surface onto which the compactible paving material is to be laid, wherein the surface runner follows the contours of the surface onto which the compactable paving material is to be laid, and which is connected to the height adjustable mounting and moves the height adjustable mounting by an amount that is proportionate to its own movement by the surface runner.

7. The compactible layer paving material compaction compensation apparatus according to claim 1 wherein the compactible layer paving material compaction compensation apparatus is adjustable to be pre-set for different compensating factors based on different expected compaction of different compactable paving material.

8. The compactible layer paving material compaction compensation apparatus according to claim 5 wherein the compensating factor is adjustable by varying the distance between the surface level detector and the height adjustable mounting in a direction of travel.

9. The compactible layer paving material compaction compensation apparatus according to claim 5 wherein the paving machine sensor and the surface level detector are connected via a lever, wherein respective connection positions of the paving machine sensor and the surface level detector relative to the lever determines the compensating factor.

10. The compactible layer paving material compaction compensation apparatus according to claim 9 wherein the paving machine sensor is mounted to the lever at a position between a fulcrum of the lever and the surface level detector.

11. The compactible layer paving material compaction compensation apparatus according to claim 1 wherein the height adjustable mounting is length adjustable so as to vary the compaction compensating factor.

12. The compactible layer paving material compaction compensation apparatus according to claim 1 wherein the paving machine sensor is mounted to the paving machine by an arm that is fixed to the paving machine screed.

13. The compactible layer paving material compaction compensation apparatus according to claim 12 wherein the height of the paving machine sensor relative to the arm is adjustable via the height adjustable mounting.

14. The compactible layer paving material compaction compensation apparatus according to claim 1 comprising:

a compaction adjustment mechanism for automatically adjusting the compaction compensation factor based on the thickness of the layer being laid down in real time, and wherein the mechanism includes:

a surface level detector for contacting the surface and detecting changes in the contours of the surface onto which the paving material is to be laid, an inclined surface, and an inclined surface runner traversing the inclined surface in response to movement of the surface level detector due to contours of the surface onto which the paving material is to be laid.

15. The compactible layer paving material compaction compensation apparatus according to claim 14 wherein the surface level detector comprises the inclined surface.

16. The compactible layer paving material compaction compensation apparatus according to claim 14 wherein the surface level detector is a dolly comprising the inclined surface.

17. The compactible layer paving material compaction compensation apparatus according to claim 1 wherein the paving machine sensor is attached to the paving machine screed by the height adjustable mounting and the compactible layer paving material compaction compensation apparatus further comprises the mechanism for automatically height adjusting the height adjustable mounting, wherein mechanism for automatically height adjusting the height adjustable mounting adjusts the height of the paving machine sensor relative to the paving machine screed by the compaction compensating factor and the compaction compensation system further comprises a mechanism for automatically adjusting the compaction compensation factor.

18. The compactible layer paving material compaction compensation apparatus according to claim 14 wherein the automatic adjustment of the compaction compensation factor is a function of the movement of the inclined surface runner on the inclined surface in response to movement of the surface level detector due to contours of the surface onto which the paving material is to be laid.

19. The compactible layer paving material compaction compensation apparatus according to claim 1 comprising a compaction adjustment mechanism for automatically adjusting the compaction compensation factor and optionally wherein a non-linear change to the compaction compensation factor is generated.

20. The compactible layer paving material compaction compensation apparatus according to claim 1 comprising:

a surface level detector for contacting the surface and detecting changes in the contours of the surface onto which the paving material is to be laid, an inclined surface an inclined surface runner traversing the inclined surface wherein the compaction compensation factor is adjustable by:

(i) changing the inclination optionally the rate of inclination and/or the angle of inclination; and/or (ii) changing the relative position of the inclined surface to the surface runner that traverses on the inclined surface.

21. The compactible layer paving material compaction compensation apparatus according to claim 5 wherein the surface level detector is connected to the paving machine in a towing arrangement and the compaction compensation factor is adjustable by changing a tow position on the compactible layer paving material compaction compensation apparatus relative to the paving machine.

22. A compactable paving material paving machine compaction compensation system, the compactable paving material paving machine compaction compensation system comprising:

a paving machine comprising:

a) a height adjustable screed for laying a layer of compactable paving material onto a surface;

b) a sensor for sensing a height of the screed relative to a reference level, the sensor being attached to the screed by a height adjustable mounting;

c) a screed height control system for automatically adjusting the height of the screed in response to different heights sensed by the sensor due to contours of the surface, wherein the screed height control system for automatically adjusting the height of the screed in response to different heights sensed by the sensor due to contours of the surface adjusts the screed to lay a layer of varying thickness; and a compaction compensator comprising:

a) a means for automatically height adjusting the height adjustable mounting by a compaction compensating factor wherein the compaction compensating factor is applied to a height of the sensor relative to the screed height, and wherein the compaction compensation is based on a thickness of a layer of paving material being laid down.

23. A compactable paving material paving machine compaction compensation system, the compactable paving material paving machine compaction compensation system comprising:

a screed wherein the screed lays down a layer of compactable paving material onto a surface;

a sensor responsive to changes in a height of the screed wherein the sensor senses a height of the screed relative to a reference level;

a height adjustable mounting attaching the sensor to the screed; and a surface level detector configured to contact the surface onto which the paving material is to be laid and detect changes in the contours of the surface onto which the paving material is to be laid, the surface level detector mechanically joined to the height adjustable mounting to vary a distance between a height of the sensor relative to the height of the screed in response to changes in contours of a surface onto which the compactible paving material is to be laid.

24. The compactable paving material paving machine compaction compensation system according to claim 23 comprising:

a compaction adjustment mechanism for automatically adjusting the compaction compensation factor based on the thickness of the layer being laid down in real time, and wherein the mechanism includes:

the surface level detector, an inclined surface, and an inclined surface runner traversing the inclined surface in response to movement of the surface level detector due to contours of the surface onto which the paving material is to be laid.

* * * * *